US006125182A

United States Patent [19]

Satterfield

[11] Patent Number: 6,125,182

[45] **Date of Patent: *Sep. 26, 2000**

[54] CRYPTOGRAPHIC ENGINE USING LOGIC AND BASE CONVERSIONS

[75] Inventor: Richard C. Satterfield, Wellesley, Mass.

[73] Assignee: Channel One Communications, Inc., Needham, Mass.

[ * ] Notice: This patent is subject to a terminal disclaimer.

[21] Appl. No.: 09/019,916

[22] Filed: Feb. 7, 1998

Related U.S. Application Data

[63] Continuation-in-part of application No. 08/336,766, Nov. 9, 1994, Pat. No. 5,717,760.

[51] Int. Cl.[7] ..... H04K 1/00; H04L 9/28

[52] U.S. Cl. ..... 380/28; 380/37; 380/42

[58] Field of Search ..... 380/28

[56] References Cited

U.S. PATENT DOCUMENTS

| | | | |
|---|---|---|---|
| 4,751,733 | 6/1988 | Delayaye et al. | 380/42 |
| 5,001,753 | 3/1991 | Davio et al. | 380/29 |
| 5,077,793 | 12/1991 | Falk et al. | 380/28 |
| 5,113,444 | 5/1992 | Vobach | 380/47 |
| 5,307,412 | 4/1994 | Vobach | 380/42 |
| 5,412,429 | 5/1995 | Liu | 380/37 |

OTHER PUBLICATIONS

Excerpts from the books:

A. *Applied Cryptography*, Second Edition, by Bruce Schneier, 1996, pp. 13–15, and 304–306.

B. *Cryptography: An Introduction to Computer Security*, by Jennifer Seberry and Josef Pierprzyk, 1989, pp. 70 and 71; and.

C. *Crytography and Secure Communications*, by Man Yound Rhee, 1994, pp. 12, and 13.

Neal Koblitz, Number Theory and Cryptography, 2e, pp. 1–2, 65–76, 1994.

Bruce Schneier, Applied Cryptography, 2e, pp. 10–13, 189–211, 242–254, 304–306, 423–428, 1996.

Michael E. Marotta, The Code Book, All About Unbreakable Codes and How to Use Them, pp. 32–36, 1983.

*Primary Examiner*—Gail O. Hayes
*Assistant Examiner*—James Seal
*Attorney, Agent, or Firm*—Cesari & McKenna

[57] ABSTRACT

Apparatus and method for encrypting and decrypting using permutation, concatenation and decatenation together with rotation and arithmetic and logic combining with elements or digits or characters from random, pseudo-random, or arbitrary sources wherein the plaintext may be partitioned, block-by-block, the block size being a user selectable power of 2 in size. The data bytes in the input block are selected M bytes at a time, where M≧2, with permuted addressing to form a single concatenated data byte, CDB. The CDB is modified by rotating (or barrel shifting) a random bit distance. The CDB may also be modified before or after rotation by simple arithmetic/logic operations. After modification, the CDB is broken up into M bytes and each of the M bytes is placed into the output block with permuted addressing. The output block, or ciphertext, may again be used as an input block and the process repeated with a new output block. This scheme may be used as an encryption method by itself or in conjunction other block encryption methods. The latter may be accomplished by using this scheme between successive stages of other encryption methods on blocked data, or between an internal stage of these other methods. The sources of random numbers used to determine the distance for the random rotation operation can be from: a pseudo-random number generator, sampled music CD-ROMs, entries in tables, arrays, buffers, or any other digital source.

18 Claims, 19 Drawing Sheets

Controller Variables, Counters & Pointers sent to Data Modifier

| Name | Type | Description | Ref. Figs. |
|---|---|---|---|
| ECV1 | byte | First Encoder Control Variable | 2C |
| ECV2 | byte | Second Encoder Control Variable | 2C |
| ALV | variable | Arithemetic/Logic Value | 2C |
| ALC | counter | Counter for ALV | |
| RV1 | variable | Rotate Value #1 | 2C, 4C #90 |
| RC1 | counter | Counter for RV1 | |
| RV2 | variable | Rotate Value #2 | 2C, 4C #91 |
| RC2 | counter | Counter for RV2 | |
| MRV1 | variable | First Mast Rotate Value | 2C, 4A #92 |
| MRC1 | counter | Counter for MRV1 | |
| MRV2 | variable | Second Mask Rotate Value | 2C, 4A #93 |
| MRC2 | counter | Counter for MRV2 | |
| General Pointer | pointer | Pointer into RDT for location of next retrieve byte | |
| Input Pointer | pointer | Pointer into Source I/O Buffer for location of next byte | 4A #94 |
| Output Pointer | pointer | Pointer into Destination I/O Buffer for location of next byte | 4A #95 |
| Array #1 Pointer | pointer | Pointer into Mask Array #1 for location of next retrieved byte | 4A #96 |
| Array #2 Pointer | pointer | Pointer into Mask Array #2 for location of next retrieved byte | 4A #97 |
| M1 ATTColumn No. | variable | M1 ATT Column Number | |
| M1 ATT Block Number (ATTB) | variable | M1 ATT Block number | |
| M1 ATTC | counter | M1 ATT Counter | |
| M1 Offset #1 | variable | M1 First Offset Additive Value | |
| M1 Address Mask #1 | variable | M1 First XOR Mask value | |
| M1 Offset #2 | variable | M1 Second Offset Additive Value | |
| M1 Address Mask #2 | variable | M1 Second XOR Mask value | |
| M2 ATTColumn No. | variable | M2 ATT Column Number | |
| M2 ATT Block Number (ATTB) | variable | M2 ATT Block number | |
| M2 ATTC | counter | M2 ATT Counter | |

*Fig. 2A*

Controller Variables, Counters & Pointers sent to Data Modifier

| Name | Type | Description |
|---|---|---|
| M2 Offset #1 | variable | M2 First Offset Additive Value |
| M2 Address Mask #1 | variable | M2 First XOR Mask value |
| M2 Offset #2 | variable | M2 Second Offset Additive Value |
| M2 Address Mask #2 | variable | M2 Second XOR Mask value |
| INPUT ATTColumn No. | variable | INPUT ATT Column Number |
| INPUT ATT Block Number (ATTB) | variable | INPUT ATT Block number |
| INPUT ATTC | counter | INPUT ATT Counter |
| INPUT Offset #1 | variable | INPUT First Offset Additive Value |
| INPUT Address Mask #1 | variable | INPUT First XOR Mask value |
| INPUT Offset #2 | variable | INPUT Second Offset Additive Value |
| INPUT Address Mask #2 | variable | INPUT Second XOR Mask value |
| OUTPUT ATTColumn No. | variable | OUTPUT ATT Column Number |
| OUTPUT ATT Block Number (ATTB) | variable | OUTPUT ATT Block number |
| OUTPUT ATTC | counter | OUTPUT ATT Counter |
| OUTPUT Offset #1 | variable | OUTPUT First Offset Additive Value |
| OUTPUT Address Mask #1 | variable | OUTPUT First XOR Mask value |
| OUTPUT Offset #2 | variable | OUTPUT Second Offset Additive Value |
| OUTPUT Address Mask #2 | variable | OUTPUT Second XOR Mask value |
| Initial - ALC | optional | Initial Counter Value - (used if ECV2 bit is set) |
| Initial - RC1 | optional | Initial Counter Value - (used if ECV2 bit is set) |
| Initial - RC2 | optional | Initial Counter Value - (used if ECV2 bit is set) |
| Initial - MRC1 | optional | Initial Counter Value - (used if ECV2 bit is set) |
| Initial - MRC2 | optional | Initial Counter Value - (used if ECV2 bit is set) |
| Initial - M1 ATTC | optional | Initial Counter Value - (used if ECV2 bit is set) |
| Initial - M2 ATTC | optional | Initial Counter Value - (used if ECV2 bit is set) |
| Initial - INPUT ATTC | optional | Initial Counter Value - (used if ECV2 bit is set) |
| Initial - OUTPUT ATTC | optional | Initial Counter Value - (used if ECV2 bit is set) |

*Fig. 2B*

ADDRESS TRANSLATION TABLE COLUMN STRUCTURE

| | | | |
|---|---|---|---|
| **ATTCOLUMN NUMBER** | ... | 1 | 2 |
| **ATTN**<br>NUMBER OF ATT BLOCK ENTRIES FOR THAT COLUMN | ... | 3 | 5 |
| **ATTSIZE**<br>THE SIZE OF THE ADDRESS BLOCKS | ... | 1024 | 16384 |
| **ATTBASE**<br>THE NUMBER BASE TO BE USED FOR THE ATT XORn OPERATION. | ... | 2 | 2 |
| **ATT BLOCK ENTRY 1** | ... | ATT BLOCK OF 1024 ENTRIES | ATT BLOCK OF 16384 ENTRIES |
| **ATT BLOCK ENTRY 2** | ... | ATT BLOCK OF 1024 ENTRIES | ATT BLOCK OF 16384 ENTRIES |
| **ATT BLOCK ENTRY 3** | ... | ATT BLOCK OF 1024 ENTRIES | ATT BLOCK OF 16384 ENTRIES |
| **ATT BLOCK ENTRY 4** | ... | N/A | ATT BLOCK OF 16384 ENTRIES |
| **ATT BLOCK ENTRY 5** | ... | N/A | ATT BLOCK OF 16384 ENTRIES |

*Fig. 5B*

BLOCK DIAGRAM OF ROTATE SECTION WITHOUT ARITHMETIC/LOGIC OPERATIONS

| PASS No. | NUMBER OF SEGMENTS | | | SORTED AVERAGE - BITS PER SEGMENT | | | | | | | |
|---|---|---|---|---|---|---|---|---|---|---|---|
| | Min | Ave | Max | Seg 1 | Seg 2 | Seg 3 | Seg 4 | Seg 5 | Seg 6 | Seg 7 | Seg 8 |
| 1 | 2 | 2.000 | 2 | 5.714 | 2.286 | | | | | | |
| 2 | 2 | 2.857 | 3 | 4.611 | 2.286 | 1.103 | | | | | |
| 3 | 2 | 3.592 | 4 | 3.911 | 2.147 | 1.312 | 0.630 | | | | |
| 4 | 2 | 4.222 | 5 | 3.417 | 2.016 | 1.327 | 0.890 | 0.350 | | | |
| 5 | 2 | 4.761 | 6 | 3.047 | 1.913 | 1.269 | 0.971 | 0.650 | 0.149 | | |
| 6 | 2 | 5.224 | 7 | 2.766 | 1.811 | 1.195 | 0.993 | 0.828 | 0.364 | 0.043 | |
| 7 | 2 | 5.619 | 8 | 2.549 | 1.697 | 1.132 | 0.999 | 0.920 | 0.563 | 0.134 | 0.006 |
| 8 | 3 | 5.959 | 8 | 2.376 | 1.579 | 1.084 | 1.000 | 0.964 | 0.716 | 0.256 | 0.025 |
| 9 | 3 | 6.257 | 8 | 2.230 | 1.467 | 1.052 | 1.000 | 0.984 | 0.821 | 0.388 | 0.058 |
| 10 | 3 | 6.516 | 8 | 2.102 | 1.366 | 1.032 | 1.000 | 0.993 | 0.891 | 0.511 | 0.105 |
| 11 | 3 | 6.744 | 8 | 1.985 | 1.282 | 1.019 | 1.000 | 0.997 | 0.935 | 0.620 | 0.163 |
| 12 | 3 | 6.941 | 8 | 1.878 | 1.213 | 1.011 | 1.000 | 0.999 | 0.962 | 0.710 | 0.228 |
| 13 | 3 | 7.110 | 8 | 1.778 | 1.159 | 1.006 | 1.000 | 0.999 | 0.978 | 0.782 | 0.297 |
| 14 | 3 | 7.255 | 8 | 1.687 | 1.118 | 1.004 | 1.000 | 1.000 | 0.987 | 0.838 | 0.367 |
| 15 | 3 | 7.377 | 8 | 1.604 | 1.086 | 1.002 | 1.000 | 1.000 | 0.993 | 0.881 | 0.435 |
| 16 | 4 | 7.478 | 8 | 1.529 | 1.063 | 1.001 | 1.000 | 1.000 | 0.996 | 0.913 | 0.498 |
| 17 | 4 | 7.563 | 8 | 1.462 | 1.046 | 1.001 | 1.000 | 1.000 | 0.997 | 0.936 | 0.558 |
| 18 | 4 | 7.634 | 8 | 1.402 | 1.034 | 1.000 | 1.000 | 1.000 | 0.999 | 0.954 | 0.612 |
| 19 | 5 | 7.693 | 8 | 1.349 | 1.024 | 1.000 | 1.000 | 1.000 | 0.999 | 0.966 | 0.661 |
| 20 | 5 | 7.742 | 8 | 1.302 | 1.018 | 1.000 | 1.000 | 1.000 | 1.000 | 0.976 | 0.705 |
| 21 | 5 | 7.783 | 8 | 1.261 | 1.013 | 1.000 | 1.000 | 1.000 | 1.000 | 0.983 | 0.744 |
| 22 | 5 | 7.818 | 8 | 1.225 | 1.009 | 1.000 | 1.000 | 1.000 | 1.000 | 0.988 | 0.778 |
| 23 | 5 | 7.846 | 8 | 1.194 | 1.006 | 1.000 | 1.000 | 1.000 | 1.000 | 0.991 | 0.808 |
| 24 | 5 | 7.870 | 8 | 1.167 | 1.005 | 1.000 | 1.000 | 1.000 | 1.000 | 0.994 | 0.835 |
| 25 | 5 | 7.890 | 8 | 1.144 | 1.003 | 1.000 | 1.000 | 1.000 | 1.000 | 0.995 | 0.857 |
| 26 | 5 | 7.907 | 8 | 1.124 | 1.002 | 1.000 | 1.000 | 1.000 | 1.000 | 0.997 | 0.877 |
| 27 | 5 | 7.920 | 8 | 1.107 | 1.002 | 1.000 | 1.000 | 1.000 | 1.000 | 0.998 | 0.894 |
| 28 | 5 | 7.932 | 8 | 1.092 | 1.001 | 1.000 | 1.000 | 1.000 | 1.000 | 0.998 | 0.909 |
| 29 | 5 | 7.942 | 8 | 1.079 | 1.001 | 1.000 | 1.000 | 1.000 | 1.000 | 0.999 | 0.921 |
| 30 | 5 | 7.951 | 8 | 1.068 | 1.001 | 1.000 | 1.000 | 1.000 | 1.000 | 0.999 | 0.932 |
| 31 | 5 | 7.958 | 8 | 1.058 | 1.000 | 1.000 | 1.000 | 1.000 | 1.000 | 0.999 | 0.942 |
| 32 | 6 | 7.964 | 8 | 1.050 | 1.000 | 1.000 | 1.000 | 1.000 | 1.000 | 1.000 | 0.950 |

*Fig. 8*

CRYPTOGRAPHIC ENGINE USING LOGIC AND BASE CONVERSIONS

This patent application is a continuation-in-part of U.S. application Ser. No. 08/336,766 an allowed prior application, filed Nov. 9, 1994, that has matured into U.S. Pat. No. 5,717,760, and that issued Feb. 10, 1998. The disclosure of this patent is hereby incorporated by reference as though set out at length herein. This application is also closely related to pending U.S. patent application Ser. No. 09/019,915.

FIELD OF THE INVENTION

The present invention relates to apparatus and methods for encryption and decryption wherein a ciphertext is generated. More particularly, the present invention is related to the use of symmetric private key encryptions. This invention contains changes which improve the security of the resulting ciphertext and well as features which aid in masking the arrays used to encrypt information from statistical analysis of the ciphertext.

BACKGROUND OF THE INVENTION

Dr. Man Young Rhee, in his book "Cryptography and Secure Communications" (McGraw-Hill, 1994) states on page 12: "A cryptosystem which can resist any cryptanalytic attack, no matter how much computation is allowed is said to be unconditionally secure. The one time pad is the only unconditionally secure cipher in use. One of the most remarkable ciphers is the one-time pad in which the ciphertext is the bit-by-bit modulo-2 sum of the plaintext and a nonrepeating keystream of the same length. However, the one-time pad is impractical for most applications because of the large size of the nonrepeating key."

U.S. Pat. No. 5,113,444 issued May 12, 1992 entitled "RANDOM CHOICE CIPHER SYSTEM AND METHOD" states "First random number strings are a relatively scarce commodity. Second, the receiver must have at hand exactly the same random number sequence the sender used or must be able to reproduce it. The first of these alternatives requires the sharing of an enormous amount of key material. The sharing of an enormous amount of key material is impractical. The second alternative is impossible." The first and second conclusions to these statements are inaccurate. Statistical analysis of the sampling of digital sources (specifically 16 bit sound files) shows that random or arbitrary numbers or bytes are readily available in the digital/computer environment. This ready availability of random numbers is contrary to the teachings and opinions of those skilled in the art as well as those expert in the art of cryptography.

Another prevailing view of those skilled in the art is that most pseudo-random numbers have an inherent weakness because they are generated by a formula and that it may be possible to reconstruct the formula and then predict the numbers in the series.

U.S. Pat. No. 4,751,733 entitled "SUBSTITUTION PERMUTATION ENCIPHERING DEVICE" describes in the abstract: "A substitution-permutation enciphering device. This device, adapted for transforming a binary word into another binary word, by succession of substitutions and permutations, under the control of a key . . . " teaches away from the scheme described herein. The use of a substitution memory as described by U.S. Pat. No. 4,751,733 has a limitation in that this patent discloses and teaches changes only to the bits of a byte.

U.S. Pat. No. 5,001,753 entitled "CRYPTOGRAPHIC SYSTEM AND PROCESS AND ITS APPLICATION" describes the use of a rotational operator in an accumulator. The rotation operation is used to cause an accumulator bit to be temporarily stored in the carry bit, rather than in a memory location, and the carry bit (regardless of its value) is ultimately rotated back into its original position. The rotate operation is explained in detail by column 3 line 61 through column 4 line 6. Also described is the processing within a microprocessor using an eight bit (1 byte) accumulator. The '753 patent is limited to the rotate operation in conjunction with an accumulator.

U.S. Pat. No. 5,113,444, entitled "RANDOM CODING CIPHER SYSTEM AND METHODS," and U.S. Pat. No. 5,307,412, teach the use of a thesaurus and/or synonyms together with arithmetic/logic operations to combine data and masks to accomplish encoding/decoding. These patents are thus limited by the use of the thesaurus and synonyms.

U.S. Pat. No. 5,412,729 entitled "DEVICE AND METHOD FOR DATA ENCRYPTION" introduces the concept of using matrix operations to multiplex the bytes in the cleartext so that a byte in the ciphertext may contain elements of more than one cleartext bytes. The patent teaches about the multiple use of a data element to create a ciphertext element. This is different from the combination of: creating a single working element by concatenating several bytes together (with permutation of sequence during the concatenation), binary rotating the resultant single element, and the breaking up the single element back into multiple bytes to be placed in an output buffer (also with permutation of sequence). Under certain conditions, a matrix presentation may be used to represent the effect of the rotation operation. However, careful examination will show that the matrix representation of the rotation operation does not follow the rules associated with a linear system and thus is quite different from this patent. This patent method is limited by teaching the multiplexes several different data elements together wherein each element may be used more than once, while the scheme herein only modifies a single data element at any one time.

U.S. Pat. No. 5,077,793 entitled "RESIDUE NUMBER ENCRYPTION AND DECRYPTION SYSTEM" teaches (column 3 lines 40 to column 4 lines 8): "if the moduli are chosen to be mutually prime, then all integers with the range of zero to the product of the moduli minus one can be uniquely represented. The importance of the residue number system to numerical process is that the operations of addition, subtraction, and multiplication can be performed without the use of carry operations between the moduli. In other words, each digit in the n-tuple can be operated on independently and in parallel." And shows that for the sum Z of the digits X and Y, the ith digit may be given by: $z_i=(x_i+y_i) \bmod m_i$ and that "a sixteen bit binary number can be represented in the residue number system using five moduli 5,7,11,13,17." The moduli ($m_i$) are chosen to be relatively prime to each other. In Columns 5 and 6 the description goes on to define $Z=(X+Y) \bmod M$ (where M is the product of all of the moduli, i.e., $M=m_1 \times m_2 \ldots m_n$,) as a generalization of the Vigenere cipher. If $Z=(X-Y) \bmod M$ is used to encrypt X using Y then X may be recovered from Z by $X=(Y-Z) \bmod M$, which is a generalization of the Beaufort cipher.

Pages 305 and 306 in "Applied Cryptography, Second Edition" by Bruce Schneier, John Wiley & Sons, Inc. 1996—describe the Madryga encryption method. "The Madryga consists of two nested cycles. The outer cycles repeats eight time (although this could be increased if security warrants) and consists of an application of the inner cycle to the plaintext. The inner cycle transforms plaintext to ciphertext and repeats once for each 8-bit block (byte) of the plaintext. Thus the algorithm passes through the entire plaintext eight successive times. An iteration of the inner cycle operates on a 3-byte window of data, called the working frame [figure reference omitted]. This window advances 1 byte for each iteration. (The data are considered circular when dealing with the last 2 bytes.) The first 2 bytes of the working frame are together rotated a variable number of positions, while the last byte is XORed with some key bits. As the working frame advances, all bytes are successively rotated and XORed with key material. Successive rotations overlap the results of a previous XOR and rotation, and the data from the XOR is used to influence the rotation. This makes the entire process reversible. Because every byte of data influences the 2 bytes to its left and the 1 byte to its right, after eight passes every byte of the ciphertext is dependent upon 16 bytes to the left and 8 bytes to the right. When encrypting, each iteration of the inner cycle starts the working frame at the next-to-last byte of the plaintext and advances circularly through to the third-to-last byte of the plaintext. First, the entire key is XORed with a random constant and then rotated to the left 3 bits. The low-order 3 bits of the low-order byte of the working frame are saved; they will control the rotation of the other 2 bytes. Then, the low-order byte of the working frame is XORed with the low-order byte of the key. Next, the concatenation of the 2 high-order bytes are rotated to the left the variable number of bits (0 to 7). Finally, the working frame is shifted to the right 1 byte and the whole process repeats." On page 306, "Both the key and the 2 ciphertext bytes are shifted to the right. And the XOR is done before the rotations." The Madryga method may be improved upon by a better randomizing of the order of the bytes prior to concatenation and by not storing the rotate distance information (even though it is encrypted) in the data itself. A weakness of this method is that the order of the bytes prior to concatenation is unmodified and therefore more easily broken.

The terms engine, encoder, decoder are used interchangeably herein.

Herein a relative address pointer (rap or RAP) is defined as relative address index, pointing to an entry within a table of bytes, an array of bytes or an I/O buffer. When relative addresses are supplied by a counter, that counter is constructed so that it counts modulo the size of the I/O Buffer, Mask Array, or table with which it is associated. When the size of an array or I/O buffer is a power of 2 in length, then an ordinary binary counter may usually be used to supply the relative address pointers.

Address scrambling is defied herein as the modification of a relative address pointer (RAP) so that its value is changed through the uses of any combination of: additive (or subtractive) values, XORing (exclusive-or) of mask values or by table lookup values, creating a scrambled relative address pointer (srap or SRAP).

Address Translation Table operations are defined herein as ATT Operations. This will mean the converting of a relative address pointer (RAP) into a scrambled relative address pointer (SRAP).

ATT Entries, or ATT Block Entries, or ATT Blocks, are defined herein as tables of relative address pointers or modified relative index values $2^N$ in size, having values of 0 to $_2{}^N-1$. Other sized ATT Block Entries may be used for non-power-of 2 XORn and ATT Block Entry Modulo operations. For example, an ATT Block of 1014 entries will use an XORn (based 13) and a Modulo operation of 1014. Each ATT Block contains only 1 unique value in its range. There are no duplicate entry values and thus an ATT Block is completely different from a thesaurus as defined in either U.S. Pat. No. 5,113,444 or U.S. Pat. No. 5,307,412 because no synonyms or duplicate entries are present. The size of the I/O buffers and Masking Arrays should be an integer multiple of the ATT Block Entries to be used with them. Thus if a ATT Block Entry for I/O is 1000, then the I/O Buffers should be integer multiples of 1000 bytes in size. If the masking arrays are 64K in size, then a ATT Block Entry for them should be a power of 2 in size less than or equal to 64K. A buffer size of 1014 is interesting if 3 byte (24 bit wide) arithemetic/logic operations are chosen.

ATT Column is defined herein as a collection of one or more ATT Blocks used one at a time so that even though the collection of multiple ATT Blocks all contain the same entries, though probably in a different order, they are not a table of Synonyms as defined by either U.S. Pat. No. 5,113,444 or U.S. Pat. No. 5,307,412. Also these ATT Blocks are used to modify the value of a relative address pointers and not the data to be encrypted or decrypted as is done by these patents.

Herein ATTN is the number of ATT Blocks in an ATT Column. Herein ATTSIZE is the ATT Block size within an ATT Column and ATT BASE is the number base for the XORn masking operations to be used with the ATT Block size. Herein ATTB is the number of the ATT Block Entry being used (counting from 0 upwards) within an ATT Column. Herein an Address Translation Table consist of one or more ATT columns.

Multiple byte fetches (MF's) are/is defined as the accessing from a mask array, table or buffer, of two or more bytes to create a single element comprising the logical concatenation of the bytes retrieved. Herein MF will refer to multibyte fetch operations.

Decatenation or decatenate are defined herein as the breaking apart of a single multibyte width entity, previously created by the concatenation of individual bytes, back into individual bytes.

Multiple byte put (MP) is defined herein as the breaking up, or decatenation, of a logical concatenation of bytes into 2 or more individual bytes and their placement into a table or buffer.

A byte is defined herein as being of any width greater than or equal to 2 bits.

Herein array is defined as an actual grouping of two or more elements and as a logical grouping of two or more elements, wherein an element is a bit, digit, byte or word of any length.

A barrel shifter is defined herein as being a shift register arranged such that any bits shifted off either end of the register are also shifted back in the other end of the shift register at the same time. No information is added, lost or changed in the process. A barrel shifter may also be constructed using a simple latch register and multiple selects for the inputs to the latch creating a barrel shifter which only requires one clock period to perform any size rotate. Rotation can also be performed in a register within most typical CPUs. Usually, there is an instruction native to the CPU which will perform this operation.

Herein the words, rotation, rotational operation, or rotation operation will refer to barrel shifting.

Herein an encoder pass, or PASS, is defined to mean the encoding of a block of cleartext into an intermediate-text or ciphertext block, or the decoding of a block of ciphertext into an intermediate-text or cleartext block.

BCN is defined herein as the binary to base n conversion of a number and the representation of the base n number as a digit shown in binary. A common example (base 10) is BCD (binary coded decimal) where the values 0 through 9 are represented by 4 binary bits.

It is an object of the present invention to provide a source of random, pseudo-random and arbitrary numbers to be used in the encryption/decryption processes and devices.

It is an object of the present invention to provide a concatenation operation which is used to create a single data element from smaller elements, and after modification, the single element is split up into smaller elements again - with each smaller element being used only one time.

It is yet another object of the present invention to exclude the use of thesauruses and of synonyms.

It is still another object of the present invention to provide encryption/decryption apparatus and methods wherein information data, which is to be securely transmitted between users, are permuted and shifted. The resulting information may then be combined with masking data from random, pseudo-random, or arbitrary sources to provide another level of encoding/decoding for further security.

SUMMARY OF THE INVENTION

The foregoing objects are met in an encryption apparatus and method providing an address pointer scrambler, a byte concatenator, a barrel shifter and a decatenator which ii encrypt and decrypt input data.

The present invention provides and encryption/decryption method wherein binary data may be encrypted through the use of multiple applications of the combination of: a concatenation of bytes (with permuted sequence) forming a single data item, a rotational shifting of the data item by an arbitrary amount and a separating operation or decatenation operation of the data item back into individual bytes (with permuted sequence). This method and apparatus may also employ arithmetic/logic modifications of the data during processing.

Other preferred embodiments will add to the above mentioned apparatus, one or two masking arrays, M1 and M2, of length N, a table of arbitrary bytes (RDT), additional multi-byte wide rotational operations, internal counters and control variables which direct and control the operation of data modification and the modification of relative address pointers.

The sender and receiver must agree ahead of time on: the permutation scheme, or the source of the permutation scheme. And, if used there must be agreement on the sources to be used for the masking bytes and how these sources will be sampled and/or combined to create the masking bytes, tables, variables, counters and pointers to be used to encrypt and decrypt a message.

Encoding or Decoding will consist of one or more passes through a cleartext message with the combination of: multiple byte fetches (MF concatenation) from an input buffer with address scrambling (permutation of sequence), rotation of the single element (created by concatenation) by an arbitrary amount and multiple byte puts (MP decatenation) to an output buffer with address scrambling.

To the method described in the previous paragraph may be added logical/mathematical data modifications as well as the employment of rotational operations to the values retrieved from the masking arrays. The application of a rotational operator to the retrieved bytes from the masking arrays increases the effective statistical size of the mask array from N to 8N (assuming 8 bit bytes). Consequently the effective statistical combinatorial size of the masking arrays is increased to $64N^2$. The effective combinatorial size increases beyond $64N^2$ if one considers the effects of other control bits in the ALV variable (see FIG. 4A). In addition, the introduction of multiple byte fetches (MF's) with address scrambling from the masking arrays allows the Encoder to operate as if each pass through the data has its own distinct set of masking arrays thereby increasing the security of the ciphertext.

As is known in the art, care must be used to ensure that calculations avoid duplications and are consistent with buffer sizes and bit widths, especially when number bases other than two are used.

An interesting aspect of the present invention is the address scrambling mechanism and the use of Address Translation Tables entries (ATT Columns and ATT Block Entries) to permute the order of address selection from I/O buffers A and B and from the two Masking Arrays. This scheme does not require pure random numbers to create the ATT Column Entries. Any digital source may be used, including plain text.

Another aspect of the present invention is the ATT mechanism's flexibility to generate different scrambled relative addressing pointer sequences (SRAP values) from the same ATT Block Entry through the use of offsets and masks being applied to the ATT operation. Other address scrambling techniques can be used with this invention, such as cyclic polynomial generators (for buffers of $2^N$ in size), or a shortened version of the present scheme to provide non sequential relative address pointers. The only requirement for an ATT mechanism, to be used with this scheme, is that it does not produce duplicate SRAP values within the range of RAP values that may be used for a buffer. The particular scheme described in this preferred embodiment was chosen for the relative quickness of calculation as well as it's flexibility in generating different and varied SRAP sequences. In a preferred embodiment, sequential relative address pointers for use with both the input and output buffers should be avoided. The relative address pointer for either the input or the output (or both) should be varied.

The scheme may also employ different sized ATT Column entries. For example, a 4 KB input buffer may be sourced (data fetched) with 4 different 1 KB ATT Column Block Entries and written out using a different single 4 KB ATT Column Block Entry. The only restrictions are that the ATT Block size cannot exceed the size of the Buffer or table being accessed and the Buffer should be an integer multiple of the ATT Block size.

Herein XORn (XOR+ and XOR−) describes an exclusive-or operation (base n) defined as: let the numbers A and B base n be defined (for m digits).

$$A = \sum_{i=0}^{m-1} n^i a_i \text{ and } B = \sum_{i=0}^{m-1} n^i b_i$$

Then, in a preferred embodiment, the elements A and B may be combined according to the following equations.

$$C = A\ XOR + B = \sum_{i=0}^{m-1} n^i((n + a_i + b_i)\mathrm{mod}n) \quad \text{Eq. 1}$$

$$C = A\ XOR - B = \sum_{i=0}^{m-1} n^i((n + a_i - b_i)\mathrm{mod}n) \quad \text{Eq. 2}$$

and For base 2, XORn is identical to the standard XOR operation. The conversion of a binary number to j digits (base n) is done by the successive division of the number by n where the remainder of each division becomes the ith digit for i=0 to j−1. The digits of a number (base n) are converted back to binary by: setting sum=0, then for i=j−1 to 0 perform sum=(sum * n)+digit$_j$. When done the result is in sum.

As is known in the art, care must be used to ensure that calculations avoid duplications and are consistent with buffer sizes and bit widths, especially when number bases other than two are used.

Eq. 1 is a type of Vigenere cipher using XOR+ while Eq. 2 is a Variant Beaufort cipher using XOR−. These two ciphers being applied to the digits resulting from the conversion of binary to base n numbers and the subsequent reconversion back into a number in the original number base is defined herein as XORing the numbers base n (XORn).

Arbitrary and random numbers are created by normal digital processes. Most digitized music which comes on a CD-ROM is 16 bits of Stereo sampled at a 44.1 kilohertz rate. This produces approximately 10.5 million bytes per minute. Of these about one half may be used as arbitrary data bytes, or about 5 million bytes per minute. Reasonably random data byte are generated by reading in the digital data stream which makes up the music and throwing away the top 8 bits and sampling only the lower eight bits of sound to produce an arbitrary or random number. Fourier analysis on the resultant byte stream shows no particular patterns. It should be kept in mind that silent passages are to be avoided. If taking every byte of music in order is undesirable, then using every nth byte should work quite well for small values of n between 11 and 17. Please note, the error correction inherent with a music CD-ROM is not perfect and the user might want to convert the CD-ROM music format to a WAVE (.WAV) file format and then send the WAVE (.WAV) file to someone by either modem, large capacity removable drive, digital magnetic tape cartridge, or by making a digital CD-ROM containing the WAVE (.WAV) file.

Another source of digital randomness is the pixel by pixel modification (exclusive-oring, adding, subtracting) of several pictures from a PHOTO CD-ROM, again looking at the low order bytes. Computer Zipped (.ZIP) files and other compressed file formats can be used.

In other preferred embodiments, the intelligent sampling of digital sources can be used to advantage to lessen the reconstruction of the byte stream used for encryption. In addition, encryption and hashing algorithms may be used to modify the digital sources prior to their use. Moreover, the modification of pseudo-random numbers for tables, arrays and/or masks may also be used to advantage.

In the Encoder, a General Pointer (GP) is used to retrieve an eight bit byte from the RDT. Each time the General Pointer is used, its value is incremented after the retrieval of the byte from the RDT. The General Pointer is incremented Modulo the length of the RDT.

The addition of a pre or post rotate operation to this encoding scheme increases the security of the encrypted material. In a preferred embodiment, 32 bit arithmetic/logic operations is utilized, which means that 4 bytes of data must be fetched from the input buffer at one time and written back out as 4 bytes of data to our output buffer. These 4 bytes may be rotated either left or right by any number from 1 to 31 bits. Normally, a rotate value of zero or a multiple of 8 is not is not used.

If the interface receives a zero rotate value to the Encoder, an error message is returned, but the zero rotate value will be loaded into the designated rotate distance variable (MRV1, MRV2, RV1 or RV2). If during the operation of the Encoder, a zero rotate value results from the retrieval (through the General Pointer) of a byte from the RDT (or arithmetic/logic combination of RDT and other table or mask array byte entries), then the value of the General Pointer, or other pointers, is incremented (modulo their respective lengths) and the process of retrieval is repeated until a non-zero result is obtained. For simplicity of explanation, only a General Pointer is shown for this Encoder. In another preferred embodiment, each variable has its own individual source pointer. These pointers indicate the locations within one or more tables or mask arrays which are to be used and how these retrieved byte values are to be combined to supply a byte to the Encoder for updating a variable, counter or pointer value. In addition, addressing modes, other than incremental, may be used, where individual relative address pointers into table are incremented by values other than +1, or where the next value of a relative address pointer is calculated from one or more entries presently in an array or table of bytes, thus creating a pointer which jumps around. The expansion from one General Pointer to individual source pointers is not difficult for anyone skilled in the art to implement.

In another preferred embodiment, a selectable number of pointers are assigned to the variables in a manner determined by information sent to the encoder by the user interface. By changing the assignment of pointers to encoder variables and counters, the same cleartext, the same RDT and the same Masking Arrays can produce different ciphertext outputs.

If positional scrambling is not wanted, then setting the respective ATT Mode bits in ECV2 to 11 (binary 3) or the creation of an ATT Block entry whose entries are in sequential order and the use of ATT Offset and Mask values of 0 will cause the SRAP to be the same as that of the input RAP.

Also for simplicity of the diagrams, the individual counters which are associated with each variable have been eliminated. In all preferred embodiments it is to be understood that these counters exist. In summary, each set of 4 byte fetches (1 MF) or puts (1 MP) will be considered 1 counter decrement operation for the Encoder counters associated with the Encoder control variables ALV, RV1, RV2, MRV1 and MRV2. Each ATTSIZE of ATT Operations (which equals one complete ATT Block Entry utilization) will be considered 1 counter decrement operation for all ATT variables associated with that ATT Operation. The discussion for FIG. 2C explains the counter operation is more detail.

The implementation of the Data Modifier (DM), in this application, shows arithmetic/logic operations using a base 2 number system. Other preferred embodiments are not limited to base 2. Their implementation require minor changes to the XOR operations in the data path. In another preferred embodiment the complementing of the mask values is replaced by the negation of the mask values. Through the use of another Encoder Control variable, ECV, or a regular Variable (and associated counter), the retrieved masking array values may be modified by any of: complementation, negation, hashing, or conversion to BCN digits (base n). In addition, the expansion of the ALV to two bytes allows for the negation of the data and the expansion of other A/L options such as the use of an XORn (non-power of 2). Another preferred embodiment using a second ALV operation and counter (ALV2 and ALV2C) contains bits which indicate whether the MF values (masking arrays and data), the intermediate or ending modified data elements are bit reversed. Other preferred embodiments allow for previously modified data to be used (either directly or through an additional MF operation) to modify the data presently in the DM unit. These modifications may include, rotation, bit reversal, the swapping of bits within a data or masking elements as well as the application of arithmetic/logic operations.

The RDT replaces the characters in the Password String (as previously defined in U.S. patent application Ser. No. 08/336,766) and the retrieved bytes now control the sequence of arithmetic/logic and rotational operations as well as provide counter values which control the duration of these operations usage within the Encoder.

Starting offset values for the General Pointer, the Array #1 Pointer, the Array #2 Pointer and any other initial value for a variable, counter, mask or offset may be obtained by any combination of: a Password String, hashing or other mathematical functions and values retrieved through the GP. The default starting value for the GP is assumed to be the beginning of the RDT (RAP=0).

The selection of 32 bit operations is arbitrary, other sizes such as 16 bits, 24 bits or 64 bits may be employed if desired. In another preferred embodiment, 2 bytes or 16 bit arithmetic/logic and rotational operations are employed. In the preferred embodiment shown in FIG. 4C, an additional rotate operation is inserted between the first and second Arithmetic/Logic operations. This rotate and the pre and post rotate operations also have the effect of further hiding the values of the mask arrays from detection by statistical processes.

Through the use of individual byte fetches and puts, with permuted addressing (ATT operations), it is unlikely that once the bits of a byte are split by the rotate operation and moved into another byte in an I/O buffer that these bits will be moved back into their originating byte through subsequent I/O operation during another processing pass. The formulas for the dispersion of a byte's bits into other bytes (or segments) as described below were derived from a statistical simulation using the assumption that once bits are moved out from a byte, that they may not be moved back into that byte. This assumption underlies the information presented by FIG. 8.

FIG. 8, shows the minimum, average and maximum number of 8 bit segments (bytes) which contain the original 8 bit byte as a function of the number of scramble/rotate passes performed. A simulator was built where rotates of only plus or minus 1 to 7 are allowed and once bits are moved into another byte, this other byte is treated as being independent from the original byte. Thus, the maximum number of bytes containing the original 8 bits is 8 after 7 passes of the rotate function (with address scrambling). This is the result of each rotate breaking 1 bit off with each pass. Obviously, this does not happen that frequently because 7 passes has an average result of 5.6 meaning that the original 8 bits are now spread throughout 5 to 6 other bytes (see FIG. 8).

The number of average segments S containing the original n bit wide byte as a function of the number of P Passes is approximated by the formula:

$$\bar{S}_p = n - \left(\frac{(n-2)^p}{(n-1)^{p-1}}\right) \qquad \text{Eq. 3}$$

Initially, the rotate operation has the effect of splitting a n bit data byte into two parts. The size of the smaller part (SP) is given by Eq. 4, while the larger (LP) part is given by Eq. 5:

$$SP = \frac{integer\left(\left(\frac{n}{2}\right)^2\right)}{(n-1)} \qquad \text{Eq. 4}$$

$$LP = n - SP \qquad \text{Eq. 5}$$

The rotate operation may split a byte only into a maximum of two parts for each PASS, where with U.S. Pat. No. '729 the degree of splitting (data multiplexing) is limited only by the size of the matrix and the number of integer entries in the respective matrix employed. Eq.'s 4 and 5 work well for the first rotation pass where n equals the byte width.

As shown in FIG. 8, the number of bytes over which the original eight bits are dispersed does not increase at the same rate for each additional pass executed. This is because some random rotates do not necessarily split the original bits across a byte boundary as the number of original bits per byte decrease. But what is apparent from the table in FIG. 8 is that this combination of multiple passes of rotation with address scrambling is very effective in dispersing the bits of a byte across many bytes within a buffer. In effect, the encrypted data itself is used as a dispersing medium thus eliminating the need for a separate intersperser mechanism (see U.S. Pat. No. 5,307,412 and 5,113,444). This data modifications also decreases the likelihood that cryptanalysis will yield the contents of the RDT, or any of the Masking Arrays.

This Encoder uses a symmetric private key encryption method, the sender of a message and the receiver must decide ahead of time on what sources will be used and how these sources will be accessed and used to build the ATT Entries, and other internal tables, mask arrays, counters, variable and pointers.

In other preferred embodiments, the intelligent sampling of digital sources can be used to advantage to lessen the reconstruction of the byte stream used for encryption. In addition, encryption and hashing algorithms may be used to modify the digital sources prior to their use. Moreover, the modification of pseudo-random numbers for tables, arrays and/or masks may also be used to advantage.

The utilization of arbitrary rotate operations in conjunction with an effective address scrambling scheme for accessing the I/O buffer, provides a means where polyalphabetic cryptanalysis of a ciphertext produced by this encoder is hindered.

Other objects, features and advantages will be apparent from the following detailed description of preferred embodiments thereof taken in conjunction with the accompanying drawings.

BRIEF DESCRIPTION OF THE DRAWINGS

FIGS. 2A & 2B is a listing of variables, counters, pointers and control bytes which must be saved and restored for each i/o pass;

FIG. 5B is a table showing the structure of address translation columns;

FIG. 8 is a table detailing the statistical distribution of bits as a result of multiple address scrambling/rotate passes;

DETAILED DESCRIPTION OF PREFERRED EMBODIMENTS

Figure 1:
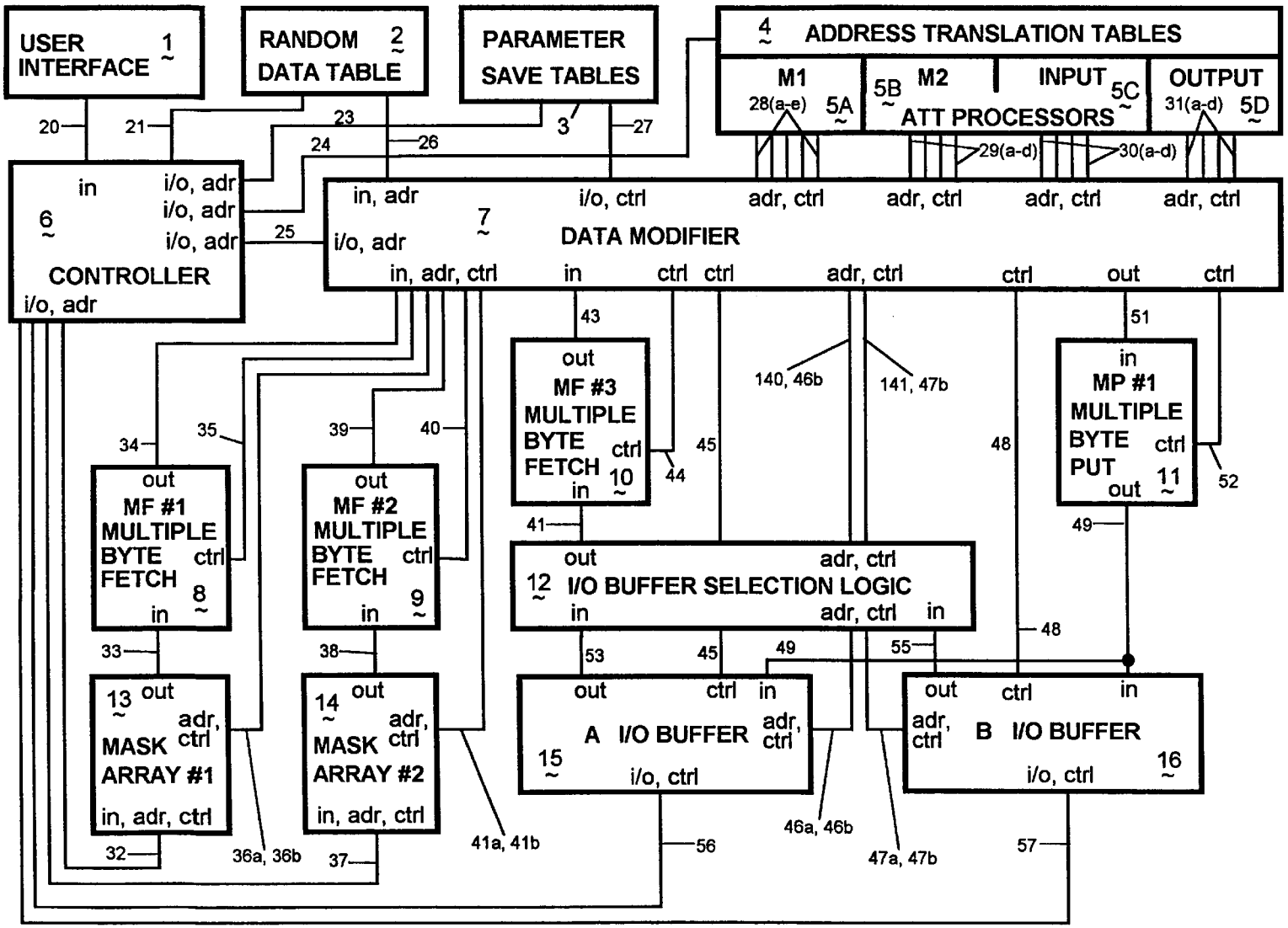
FIG. 1 is a block diagram of the encryption engine.

FIG. 1 shows a basic block diagram of the Encoder/Decoder Engine. The User Interface, 1, is used by the Controller, 6, to communicate information to and from the user. A communications bus, 20, is used to transfer information between the User Interface and the Controller. The Controller is in charge of general housekeeping details for the Encoder. It also takes commands from the User Interface which direct the Controller to place data bytes into: the masking arrays, 13 and 14, the random data table (RDT), 2, the parameter save tables, 3, the address translation tables, 4, the data modifier, 7, an I/O buffer, 15 or 16, or to read back data bytes from the previous I/O Buffers.

The binary status bit, BUFSEL (see FIG. 2C) of the encoder control variable #1, ECV1 (see FIGS. 2A and 2C) determines which of the two I/O buffers is designated for input and output. If BUFSEL=0, the A I/O Buffer (I/O-A), 15, is the input buffer, while B I/O Buffer (I/O-B), 16, is the output buffer from which information will be retrieved and sent back to the user via line 57 to the Controller and then via line 20 to the User Interface. If BUFSEL=1, the I/O-A is the output buffer and I/O-B is the input buffer. I/O, address and control lines 56 and 57 are used by the controller to load data bytes into and to read data bytes from I/O-A and I/O-B, respectively.

I/O, address and control lines 32 and 37 are used to send data bytes to Mask Array #1 (MA#1) 13, and Mask Array #2 (MA#2) 14, respectively. Similarly, line 21, is used to load data bytes into the random data table (RDT).

The RDT is a large table of bytes, some of which are periodically sent to the Data Modifier, 7, via line 26 to supply direction and control information to the Data Modifier (DM). The General Pointer (GP), see FIG. 2A, is a RAP into the RDT which designates which byte will be sent to the DM unit. After each access with the GP, the value of the GP is incremented (modulo the length of the RDT). Thus the RDT has assumed and expanded upon the direction and control function previously supplied by the Password String in parent U.S. patent application Ser. No. 08/336,766).

The Pass Number (PN and also K), from 1 to 16, is a counter value which is always kept within the Controller. It is used to indicate which processing pass is being performed, where parameters are to be stored and other information the DM might need about a processing pass. The user also determines, by information sent to the controller, how many processing passes per I/O Buffer load are to be performed.

Parameters (pointers, variable, counters, etc.) used by each encoding pass within the encoder may be loaded into the Parameter Save Tables (PST) by one of two means: either through I/O, address and control line 23 directly from the Controller, or by another I/O, address and control line 27, directly from the Data Modifier, 7. In the latter case, the parameters must first be loaded into the DM and then saved from the DM into the PST (with the appropriate pass number (PN) information being supplied by the Controller so that the information is stored in the correct section of the PST. The PST normally holds up to sixteen different sets of Parameters, though this is an arbitrary number and its value may be changed during implementation. The PST is where the encoder saves the state of the parameters of the Data Modifier, 7, after processing the I/O buffers for one pass and reloads the previously saved parameters of the Data Modifier for the next processing pass. BUFSEL is complemented after each processing pass changing the designation of input and output buffers. Care must be taken so that after the last processing pass, BUFSEL is not complemented so that it correctly points to the output buffer which holds the completed ciphertext.

The Address Translation Tables (ATT), 4, hold one or more ATT Columns which are used by the four ATT Processors (5A, 5B, 5C, 5D) to compute SRAPs for accessing MA#1, MA#2, I/O-A and I/O-B. The ATT Columns are computed outside of the Encoder and loaded into the ATT by the User Interface 2, line 20, the Controller 6, and I/O address and control line 24.

Once all tables, I/O Buffers and Masking Arrays have been created, the Controller set the pass counter K and tells the DM to load its Parameters from the PST via 27 and to process an Input Buffer.

First, the DM via lines 28*a* to 28*d* sends the MA#1 RAP (Array #1 Pointer, FIG. 2A) to the M1 ATT Processor and gets back the SRAP for the first 8 bit byte to be retrieved from MA#1. The SRAP is sent via 36*a* to MA#1 and the Array #1 Pointer value is incremented. The byte retrieved from MA#1 is sent to MF#1 via 33. After this is repeated three more times, the MF#1 now contains a 32 bit wide value (M1 FIG. 4A) which is sent via 34 to the DM unit. Similarly, the process is initiated for the RAP for MA#2 (Array #2 Pointer, FIG. 2A) to be converted into a SRAP by the M2 ATT Processor, 5B, using lines 29*a* to 29*d*, and the SRAP is sent via 41*a* to MA#2 and the Array #2 Pointer value is incremented. The resulting byte from MA#2 is sent via 38 to MF#2. Again, this process is repeated three more times and the resulting 32 bit wide value (M2 FIG. 4A) is sent via 39 to the DM unit. Next, the Input buffer RAP (Input Pointer, FIG. 2A) is sent to the INPUT ATT Processor via 30*a* to 30*d* and the resulting SRAP is sent via 140 to the I/O BUFFER SELECTION LOGIC (BSL), 12, where it is sent via 46*a* to the input I/O buffer and the Input Pointer value is incremented. Assuming BUFSEL=0, then the BUFSEL enables the I/O-A Buffer to accept the Input SRAP. The I/O-A sends a byte of Cleartext (or intermediate-text on subsequent passes) to MF#3 via 53 to the BSL then via 41 to MF#3. Again this process is repeated three times until 32 bits of data have been retrieved from the I/O buffer. The 32 bit INPUT DATA byte is sent via 43 to the DM unit. The DM unit now combines the two 32 bit retrieved mask bytes M1 and M2 (see FIGS. 4A and 4C) with the 32 bit wide INPUT DATA byte (FIGS. 4B and 4C) under control of Encoder variables and operations to form a 32 bit wide OUTPUT DATA byte (see FIG. 4C). The 32 bit wide OUTPUT DATA byte is sent to MP#1, 11, via 51. At the same time, the Output Pointer, FIG. 2A, RAP is sent to the OUTPUT ATT Processor and the Resulting SRAP, via 31*a* to 31*d*, is sent to the BSL via 141 and then via 47*a* to the Output I/O Buffer (I/O-B). The Output SRAP goes to the I/O-B via 47*a* and NOT(BUFSEL) write enables the buffer. The MP#1 decatenates the 32 bit wide INPUT DATA input into a sequence of four 8 bit bytes. Each byte is sent from the DM via 49 to the output I/O Buffer where it is written into the buffer. The MP#1 process is repeated three more times (using a new SRAP each time) until all 4 bytes have been written out into the I/O buffer. See FIGS. 4A, 4B and 4C for a more detailed diagram of the data and signal flow. This reading and writing of 4 bytes causes all non ATT counters associated with DM functions to be decremented once. If any variable's counter is decremented to zero, then depending upon the status flags in ECV1 and ECV2 (see FIG. 2C) the GP may be used to update the counter with a new value, otherwise the GP may be used to retrieve a new value for the variable. Only upon completion of the processing of a I/O buffer's ATT Block entry is the ATT counter for that buffer decremented once.

When all of the bytes in the input buffer have been processed to the output buffer, the DM units saves the values of its Parameters in the PST, via 27. The pass counter value K is incremented and, if the last Encoder pass has not been reached, then the DM reloads the parameters (for the next pass) from the PST via 27 using the new K value, complements the value of BUFSEL and processes the new input buffer (previously the output buffer). When the last Encoder pass has been processed, then the contents of the Output Buffer (ciphertext) is sent via 57 to the Controller and from the Controller via 20 to the User Interface and the user. At this point the process is restarted, K is set =1, BUFSEL=0, and a new input buffer of cleartext is loaded. If a whole buffer of clear text is not available, the remaining entries in the Input Buffer should be filled with random byte values.

Whether the value of ED (see FIG. 2C, 60) equals 0 or 1, the flow through the Encoder is the same. In fact the operations may be reversed and the encryption achieved by running the Encoder in decryption mode while decryption would then necessitate running the Encoder in encryption mode.

FIGS. 2A and 2B provide a listing of the parameters which the DM needs to have loaded in order to process a buffer of information correctly.

Figure 2C:
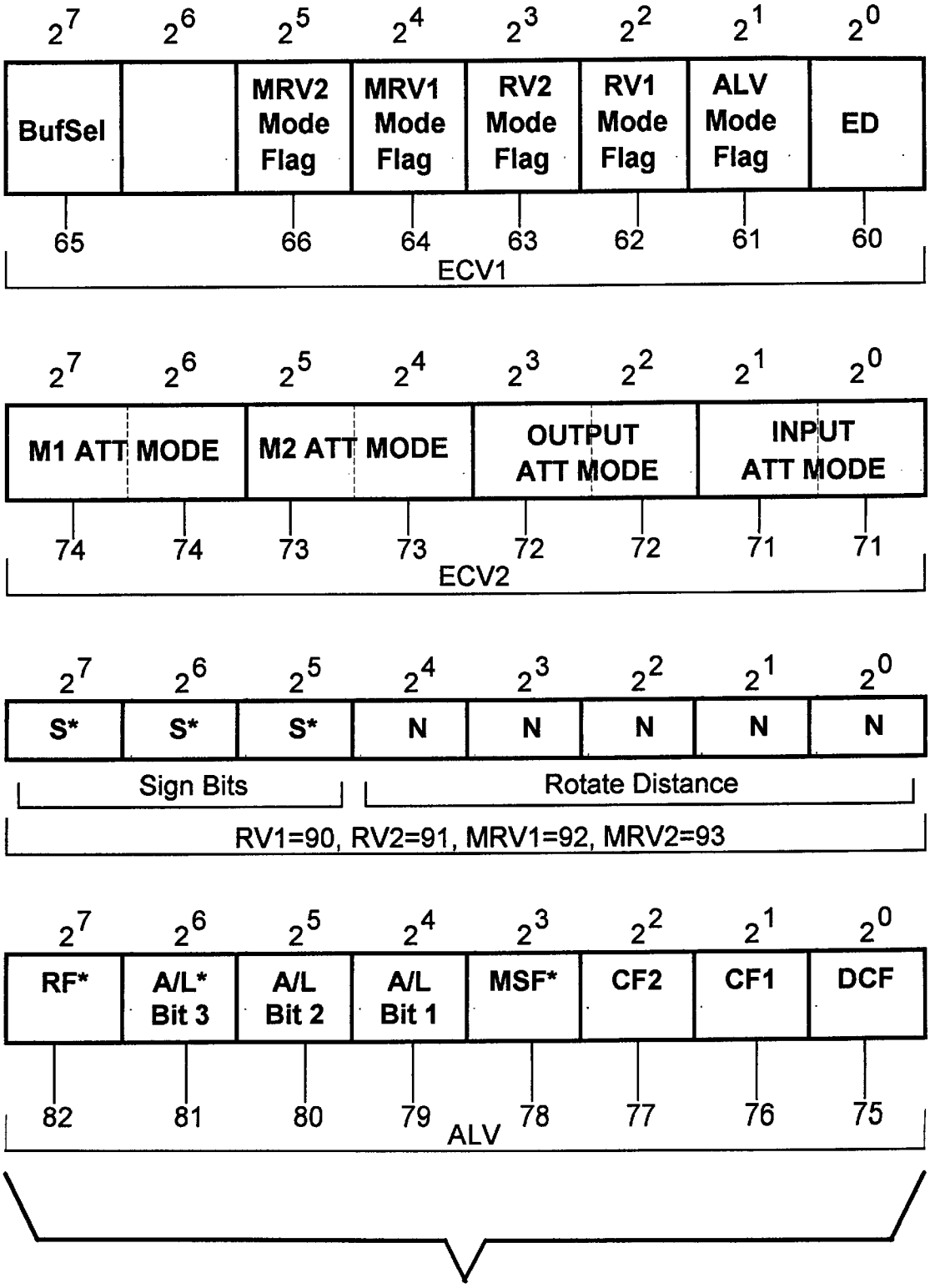
FIG. 2C illustrates the entries in the encoder control variables, as well as the formats for the rotate values and the arithmetic/logic variable.

ECV1 and ECV2 are Encoder Control Variables whose bits provide control information to the DM (see FIG. 2C). ALV is the Arithmetic/Logic control Variable. It instructs the DM on how the fetched Mask Array values are to be changed and how they are to be combined with the fetched data from the input buffer.

RV1, RV2 are the first and second rotate variables. They tell the Encoder how many 3 bits (left or right) the rotators should change the data. MRV1 and MRV2 are rotate values for the retrieved mask arrays values, see FIG. 4A for details. The incorporation of the MRV1 and MRV2 rotate operations to the values fetched from the two mask arrays increases the effective statistical combinatorial size of the arrays to $64N^2$. This is before any other functions which would increase the combinatorial size are considered.

The General Pointer (GP) points to an entry in the RDT from where the next byte of random data will be retrieved. After every byte retrieval through the GP, the GP itself is incremented (modulo the length of the RDT). In the simplified form shown in this patent application, only one GP is used for the updating of all variables, counters, masks and offsets. The user needs to decide ahead of time on the size of counters which are to be used in the DM. For example, if only 1 byte counters are used, then the maximum counter size (for variables) would be 256. If two bytes are used the maximum counter size would be 65536, etc. If two bytes are decided upon, then every time a counter needs to be updated, the GP will have to be accessed twice. Pointer values need to be wide enough to contain the complete relative addressing space for their respective table, array or buffer.

Similarly the Input Pointer, Output Pointer, Array #1 Pointer and Array #2 Pointer are used to provide RAPs to the respective ATT Processors to obtain SRAPs used to indicate the location from which a byte of information is to be retrieved. With the exception of the Array #2 Pointer, each Pointer is incremented once after each use. It is should be noted that when the Array #1 Pointer's RAP wraps around to 0, the Array #2 Pointer is incremented an additional time. This causes the Masking Array pointers to be incremented is such as way as to maximize their combinatorial usage.

For each of the M1, M2, Input and Output ATT Processors, the following variables, counters, masks and offsets are used: ATT Column Number, ATT Block Number, Offset #1, Mask #1, Offset #2, Mask #2. In addition, Each ATT Column number contains the variables ATTN and ATTSIZE for that column. ATTN is the number of ATT Block Entries contained within the column. All ATT Blocks within the ATT Column must be of the same size. ATTSIZE is the number of the entries within an ATT Block Entry. Also, the ATT Block Size must be smaller than or equal to the size of the Buffer, table or arrays with which it will be used. The ATT Process will be more completely described by the discussion associated with FIG. 3C.

At the end of the Parameters area is a section (marked optional on FIG. 2B) where the initial values for the counters are saved. These initial values may be used if the mode bit associated with that counter is set, see FIG. 2C for more details, to reload the counter after it is decremented to zero.

FIG. 2C details the bits in the control bytes ECV1 and ECV2 as well as the format for the rotate variables: RV1, RV2, MRV1, MRV2, and the details for the control bits within the ALV variable.

Within ECV1, BUFSEL determines which of the I/O buffers will be the input buffer and which one will be selected for output. If BUFSEL=0 then I/O-A is the input and I/O-B is the output buffer. If BUFSEL=1, then I/O-B is the input and I/O-A is the output buffer. BUFSEL is normally complemented between Encoder PASS operations. If a Mode Flag bits is set equal to 1 in the ECV1, then the variable associated with the particular Mode Flag will have its counter reloaded from the counter's initially loaded value. Otherwise, if the Mode Flag bit is set equal to 0, then when the counter associated with that variable decrements to zero the next counter value is retrieved through the GP.

Within ECV2 are four pairs of bits which represent the ATT MODE bits for the M1, M2, OUTPUT and INPUT ATT variables. The ATT MODE bits determine how the ATT variables will be updated when the ATT Counter (ATTC) associated with an ATT Process decrements to 0.

When the ATT MODE bits=00, then, when the ATTC decrements to zero, the ATTB only is incremented. If the ATTB was pointing to the last ATT Block within an ATT Column, then the new ATTB value is 0 and new Offset and Mask values are obtained from the RDT via the GP. The ATTC is reloaded from the saved initial value.

When the ATT MODE bits=01, then when the ATTC decrements to zero, only the ATTB is incremented. All ATT Offsets and Masks are left unchanged. The ATTC is reloaded from the saved initial value.

When the ATT MODE bits=10, then when the ATTC decrements to zero, the ATTB is left unchanged and all the ATT Offsets and Mask values are updated through the GP. The ATTC is reloaded from the saved initial value.

When the ATT MODE bits=11, then the ATT Operation is disabled, thus the SRAP equals the RAP without modification.

In another alternate preferred embodiment, when the ATT MODE bits=11, the operations are the same as when the ATT MODE bits=00, except the ATTC is updated through the GP.

In another preferred embodiment, the arithmetic/logic bit width is 16 bits (two data fetch/put operations) and the ATT address scrambling operation for the two masking arrays is eliminated.

A summary of the operation of the ATT MODE bits on the ATTC is as follows:

| Variable Name | Decrement unit | Mode Value | Action When Associated Counter = 0 |
|---|---|---|---|
| ALV, RV1, RV2, MRV1, MRV2 | 1 MF or MP Operation (4 byte fetches or Puts) | =0 | Reload with new value obtained from RDT via the General Pointer |
| | | =1 | Reload with saved initial value |
| M1 ATT values and counters<br>M2 ATT values and counters | 1 ATT Block completion (ATTSIZE for I/O or Mask Array byte fetch operations) | =00 | Increment ATTB only, after last ATT Block Entry (within the ATT Column) has been used, reset ATTB = 0 and new Offset and Mask values are obtained from the RDT via the General Pointer. ATTC is reloaded from saved initial value |
| INPUT ATT values and counters | | =01 | Increment ATTB only, all ATT offsets and mask are unchanged, ATTC reloaded from saved initial value |
| OUTPUT ATT values and counters | | =10 | Keep ATTB unchanged, update only all ATT offsets and mask values, ATTC reloaded from saved initial value) |
| | | =11 | Bypass of ATT Processor, SRAP = RAP |

The RV variables for this implementation normally have values of plus or minus 1 to 31, excepting 8, 16 or 24. Depending upon the details of the implementation, the RV can be either a two's complement number with 3 sign bits and 5 bits of distance or a two's complement number. The detail for the choice of format is left to the implementer of this method. Other preferred embodiments using other byte widths for MF and MP operations will have to have different rotate operation widths and consequently the format of the RV will need to be altered. This is quite simple for someone skilled in the art to implement. Please note that the sign bits for the RV variable are XOR'd with the ED bit to change the direction of the rotation when ED changes. Consequently if, for example, ED=0 and RV=5 indicating a right rotate of 5 bits then, when ED=1 the RV=5, would indicate a left rotate of 5 bits. The limitation on the value RV2 may take can be eliminated if desired. It is important that at least RV1, if not both RV1 and RV2, have the above value limitations imposed so as to increase the likelihood that the rotate operation will cause the bits in the multibyte wide data byte to be split across byte boundaries.

The bits in the ALV from right to left are as follows: DCF, CF1, CF2, MSF, A/L (3 bits) and RF. The RF, A/L (most significant bit) and the MSF are modified by being XORed with the value of the ED bit (ECV1). See FIGS. 4A and 4C for details.

The DCF is the DATA COMPLEMENT FLAG which when set equal to 1 causes the data to be complemented during processing.

Figure 4A:
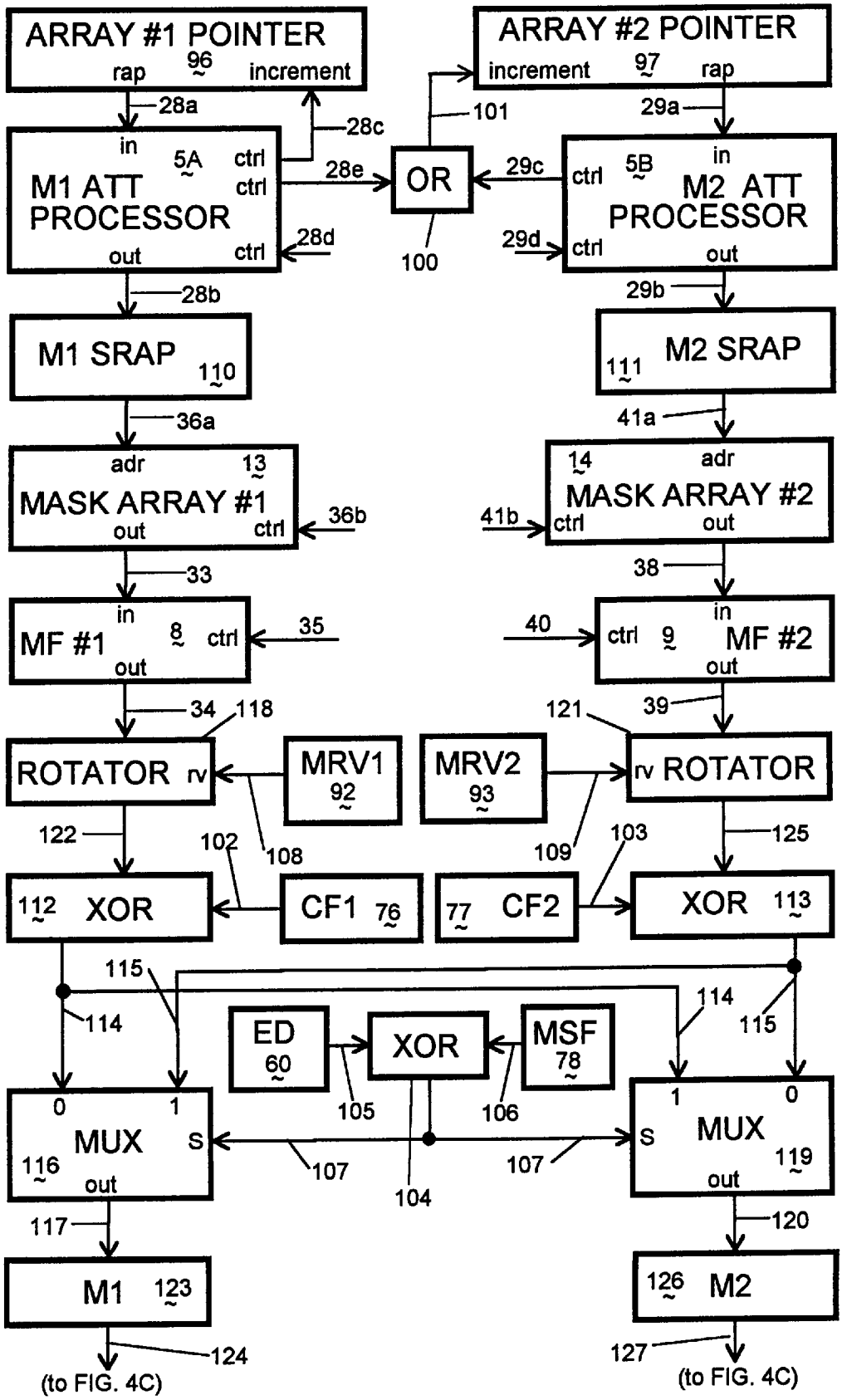
FIG. 4A is a diagram showing the mf operations being applied to the retrieval of information of mask arrays and their modification by control bits.

The bits CF1 and CF2 when set equal to 1 cause the retrieved values from the Masking Arrays #1 & #2 (respectively) to be complemented. FIG. 4A show the actions of CF1, CF2 and MSF in detail.

The MSF is the MASK SWAP FLAG, which when set equal to 1 causes the values retrieved from the masking arrays to be swapped. Details of this are shown in FIG. 4A.

The A/L bits (3 bits) are used to determine which of 8 arithmetic/Logic combinations of the two masking arrays will be used to modify the data being processed. The table below summarizes the arithmetic/Logic combinations which are used to modify the data. See FIG. 4C for details.

| Operation 1 involves A/L for M1 | | | Operation 2 involves A/L for M2 | | |
|---|---|---|---|---|---|
| 3 bit | A/L Operations | | 3 bit | A/L Operations | |
| A/L Values | #1 | #2 | A/L Values | #1 | #2 |
| 0, 0, 0 = 0 | XOR | ADD | 1, 0, 0 = 4 | SUB | XOR |
| 0, 0, 1 = 1 | XOR | SUB | 1, 0, 1 = 5 | ADD | XOR |
| 0, 1, 0 = 2 | ADD | SUB | 1, 1, 0 = 6 | ADD | SUB |
| 0, 1, 1 = 3 | ADD | ADD | 1, 1, 1 = 7 | SUB | SUB |

An example of how the complementing of the MSF and A/L3 bits by ED works and ignoring any rotation operation is as follows: let MSF=DCF=CF1=CF2=0 and assume that ED=0 (encrypt), DB=5 (concatenated cleartext data byte), M1=1, M2=2 and assume the three bits of the A/L=0, then M1 XOR the DB is 5 XOR 1=4; then the 4 ADD 2=6 (the ciphertext). Now, assume that the DB=6 (concatenated ciphertext data byte) and ED=1 (decrypt), the MSF will now be complemented so that M1=2, M2=1 and A/L will now=4 instead of 0. Therefore, DB SUB M1 which is 6−2=4 and then the 4 XOR M2 would be 4 XOR 1=5 which is the original starting value.

Another example is where A/L=2 for encryption (ED=0) an A/L=6 for decryption (ED=1). Let the DATA BYTE= DB=5 again, and the two A/L operations will be ADD and SUB. Then DB ADD M1 is 5+1=6 then SUB M2 is 6−2=4 (ciphertext). With ED=1 causing MSF to equal 1, then M1=2 and M2=1 and A/L=6 which is still ADD then SUB. Consequently, the 4 (ciphertext) ADD M1 is 4 ADD 2=6 then 6 SUB 1 which is 5 (cleartext). The precedence of order matters for XOR and ADD (also SUB) but it is not important when only ADD and SUB are used.

The RF bit is the ROTATE FIRST bit. When set=1 it causes the data to be rotated before any modification by the M1 value. If RF=0, then there will be a rotation of the modified data after the last A/L operation. Note that there is a rotate operation between the two A/L data modifications.

In another embodiment, the arithmetic/logic operations are computed using a non binary number system. The table below is an example of how the three bit A/L codes may be implemented for a non power of 2 number base using the XORn operation.

NON POWER OF 2 NUMBER BASE A/L OPERATIONS

| Operation 1 involves A/L for M1 | | | Operation 2 involves A/L for M2 | | |
|---|---|---|---|---|---|
| 3 bit | A/L Operations | | 3 bit | A/L Operations | |
| A/L Values | #1 | #2 | A/L Values | #1 | #2 |
| 0, 0, 0 = 0 | XOR+ | ADD | 1, 0, 0 = 4 | SUB | XOR− |
| 0, 0, 1 = 1 | XOR+ | SUB | 1, 0, 1 = 5 | ADD | XOR− |
| 0, 1, 0 = 2 | XOR− | ADD | 1, 1, 0 = 6 | SUB | XOR+ |
| 0, 1, 1 = 3 | XOR− | SUB | 1, 1, 1 = 7 | ADD | XOR+ |

Normally with the XORn operation the digits which result from the operation are converted back to a binary representation so that normal rotation operations may be used.

Note if arithmetic/logic operations are computed using BCN digits (non base 2) then the rotate operation will have to be modified slightly. The Rotator will now have to shift digits instead of bits and the distance portion of the RV variable will have to be interpreted differently. The table below gives the number of bits each digit will require. In base 2 a digit is a bit.

| NUMBER BASE | ROTATE DISTANCE FOR 1 DIGIT |
|---|---|
| 2 | 1 bit |
| 3 | 2 bits |
| 9 to 15 | 4 bits |

Another ECV control byte (ECV3) can be used to contain the number base for the Encoder pass. The table below gives the largest value which can be represented with BCN digits within an 8 bit byte using the designated number base.

| NUMBER BASE | MAXIMUM VALUE FOR AN 8 BIT BYTE | Bits/Digit |
|---|---|---|
| 2, 4 | 255 | 1, 2 |
| 15 | 224 | 4 |
| 14 | 195 | 4 |
| 13 | 168 | 4 |
| 12 | 143 | 4 |
| 11 | 120 | 4 |
| 10 | 99 | 4 |
| 9 | 80 | 4 |
| 3 | 80 | 2 |

With BCN digit calculations, the initial number base selected needs to be able to contain the data to be encoded. For example, an 8 bit byte with a value of $100_{10}$ cannot be used with bases 3, 9 or 10. Also, bases can be changed between passes as long as the new base is able to contain the maximum value possible with the old number base.

An advantage of using BCN digits, with data bytes that do not fully utilize the whole 8 bits of the byte, is the increased possibility (with the new number base) that the data bits will be spread out more completely over the 8 bits within the byte instead of just being clumped together. This may be helpful with some with text files where the characters may be mapped into a narrow range of values, 0 to $63_{10}$ or 0–$96_{10}$. Using base 3, for example, (with data bytes having values within the range of 0 to $63_{10}$) the data which is initially in the lower 6 bits of the byte will be converted to the whole 8 bits of the byte.

In another preferred embodiment, not shown, the MF#1 and MF#2 operations modify the elements retrieved from the masking arrays (before concatenation) by converting them to BCN digits (with truncation). Other variations, not shown, have the number base conversations taking place after the concatenation operations.

In another preferred embodiment, not shown, the order of the 4 bytes (32 bits) resulting from any of the MF operations is reversed. That is the 1st and 4th bytes are exchanges as well as the 2nd and 3rd bytes. Control for this embodiment is done by creating another encryption control byte, ECV3, and assigning three bits, one to each of the MF operations. In addition, the reversal may also be applied to the MP operation prior the actual decatenation portion of the MP operation. If the MP reversal is desired, a 4th bit is assigned in the ECV3 byte. This particular reversal is easy to implement in either software or hardware. In software, many CPU's contain an instruction which accomplishes this reversal very simply. Other byte swapping or shuffling schemes (for the 32 bit or other multibyte configurations) may be employed using the other bits within the ECV3 (or other additional ECV control bytes may be created). Note, with the appropriate offset and mask values, the ATT Process on a RAP can achieve these byte reversals.

Figure 3A:
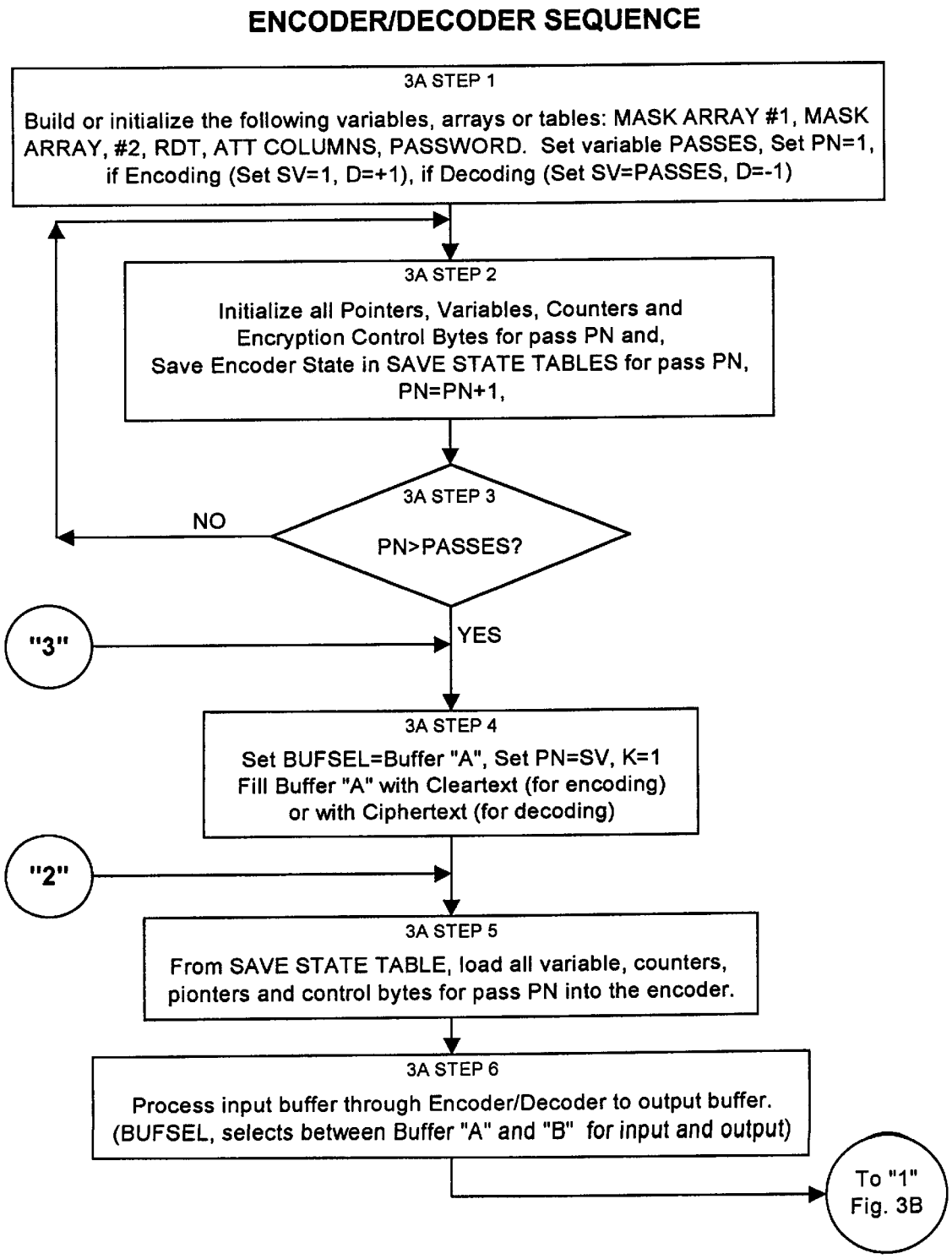
FIGS. 3A and 3B are flowcharts of the encryption/decryption sequence.
Figure 3B:
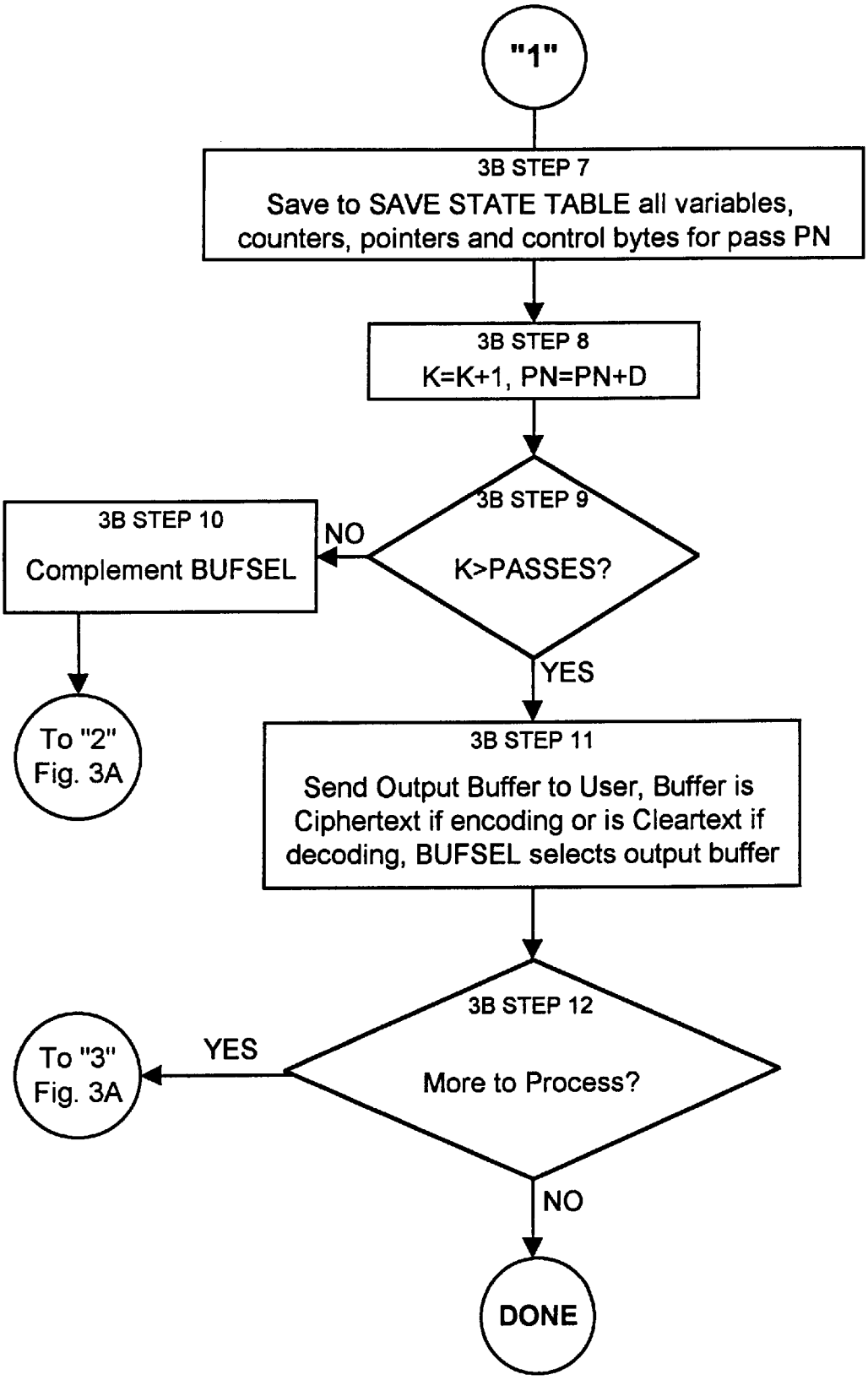

FIGS. 3A and 3*b*, ENCODER/DECODER SEQUENCE, represent a flowchart showing the sequence of Encoder operations.

3A STEP 1, is an initialization step. In this step, all tables are entered into the Encoder. These tables include the RDT, the ATT, and the two masking arrays MA#1 and MA#2. In addition, the pass number, PN, is set=1 and the total number of processing passes, PASSES, to be performed is passed to the Encoder. The local variable SV is set to the first PASS number which will be used (either 1 or PASSES) while another local variable D (±1) indicates whether the pass numbers will be counted up or down. Thus in 3A STEP 4, when encoding, the PASS number is counted up from 1 to PASSES while for decoding, the PASS number is counted down from PASSES to 1.

3A STEP's 2 and 3 are where the Parameters for each processing pass are initialized and stored in the PST.

3A STEP 4 is the first step after the initialization sequence. The Pass Number, PN is set equal to SV (either 1 or PASSES), BUFSEL is set equal to 0, and I/O-A is filled with information to be processed. The counter K is set equal to 1. Now K is used to count the number of passes processed, while PN is used to designate a pass number for use with the PST.

3A STEP 5 is where the Parameters for processing pass PN are loaded from the PST into the DM. This initializes the DM for the pass to be performed.

3A STEP 6 is where the DM processes the Input Buffer into the Output Buffer. The designation of which buffer is for input and which is for output is determined by the value of BUFSEL.

3B STEP 7 (FIG. 3B) occurs after the completion of an I/O buffer process. The Parameters for pass PN are saved in the PST table.

3B STEP 8 updates the pass counter PN by the value in D and the counter K is incremented.

3B STEP 9, if the K value is less than or equal to PASSES indicating addition processing passes are to be performed with the same I/O buffers, then the value of BUFSEL is complemented (3B STEP 10) and the process returns to "2" on FIG. 3A which goes to step 5 above for addition processing. Otherwise, when all processing passes for a buffer have been performed, BUFSEL points to the output buffer and the output buffer (3B STEP 11) is sent through the Controller to the User Interface and thus to the user.

3B STEP 12, if additional information needs to be processed, the process goes to "3" on FIG. 3A which takes the process back to 3A STEP 4, otherwise the process is done.

Figure 3C:
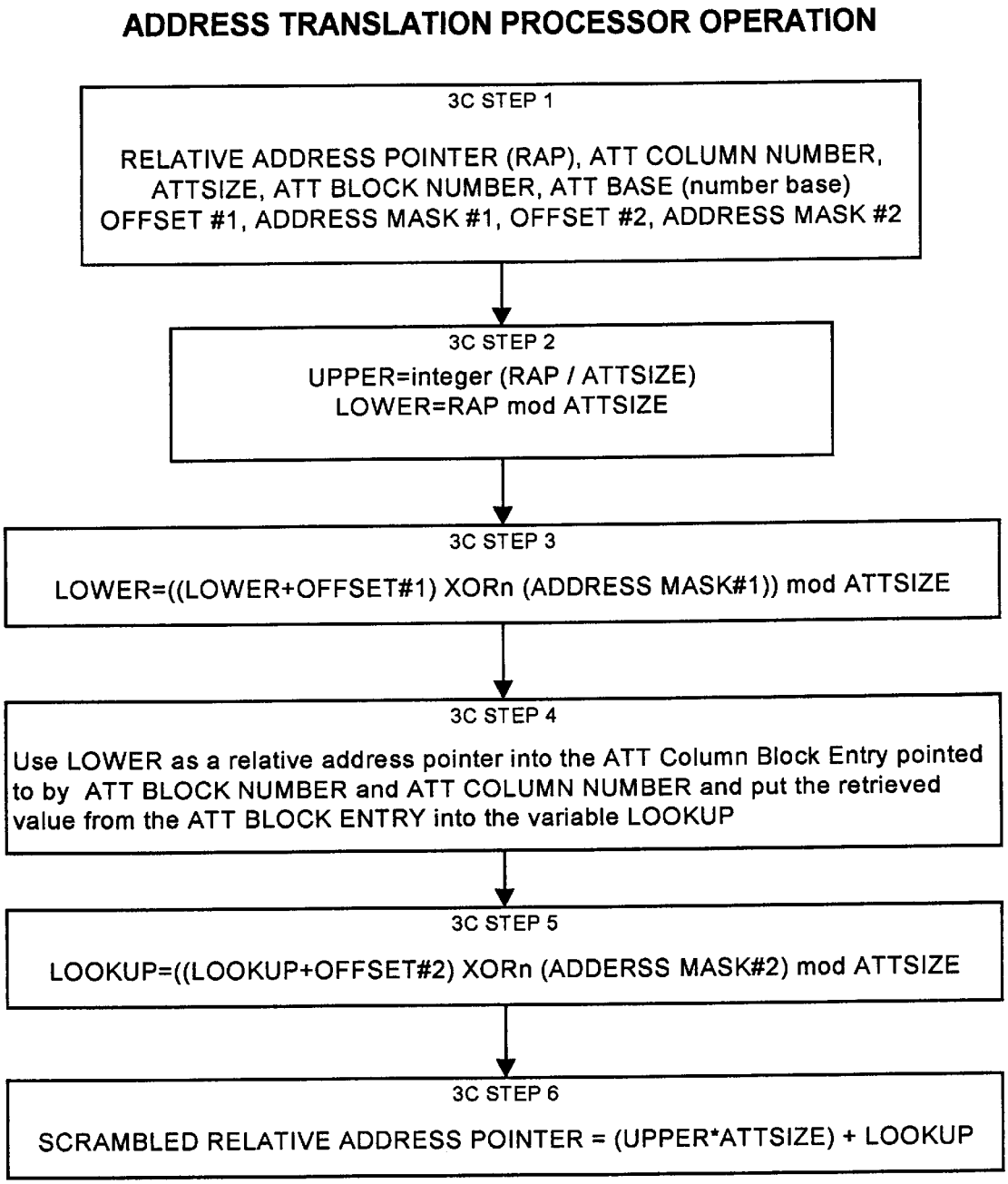
FIG. 3C is a flowchart detailing the address translation process operation.

FIG. 3C, ADDRESS TRANSLATION PROCESSOR OPERATION, is a detailed description of an ATT Process. 3C STEP 1 indicates what variables will be needed. The ATT Process requires an ATT Column with at least 1 ATT Block Entry, a RAP, the variables ATTB, OFFSET #1, MASK #1, OFFSET #2 AND MASK #2. The ATT Column contains ATTN, ATTSIZE and ATTBASE see FIG. 5B. ATTN is the number of ATT Block entries within the ATT Column while ATTSIZE is the size of the ATT Block Entries. ATTBASE is the number base to be used with the ATT operation.

It is assumed that the I/O Buffer, table or mask array being accessed is an integer multiple in size of ATTSIZE. In 3C STEP 2, the value UPPER is the RAP divided by ATTSIZE while LOWER is the RAP mod ATTSIZE. Another way to think about this is that UPPER is the quotient of RAP/ATTSIZE while LOWER is the remainder.

In 3C STEP 3, the value LOWER is modified by adding OFFSET#1 to it. If we treat the RAP as the output of a counter, then adding an offset is the same as phasing the counter. The result of the addition is XORn'd with MASK#1 and the result of this operation is taken mod ATTSIZE. The XORn introduces a nonlinear aspect to the phased value. The mod ATTSIZE operation is needed to keep the results of the ADD and XORn with the ATT Block's address space.

In 3C STEP 4, The resulting LOWER value is used as a RAP into the ATT Block pointed to by ATTB within the ATT Column. This RAP (LOWER) is used to obtain LOOKUP from the ATT Block Entry.

3C STEP 5, is the first modification of LOOKUP. Here LOOKUP is processed in a manner similar to LOWER in step 3. It is phased by adding OFFSET#2 and then XORning with MASK#2 and the result is again taken modulo ATTSIZE.

3C STEP 6, recombines UPPER and LOOKUP to create a SRAP (scrambled relative address pointer). This is accomplished by multiplying UPPER by ATTSIZE and adding LOOKUP to the product.

Figure 3D:
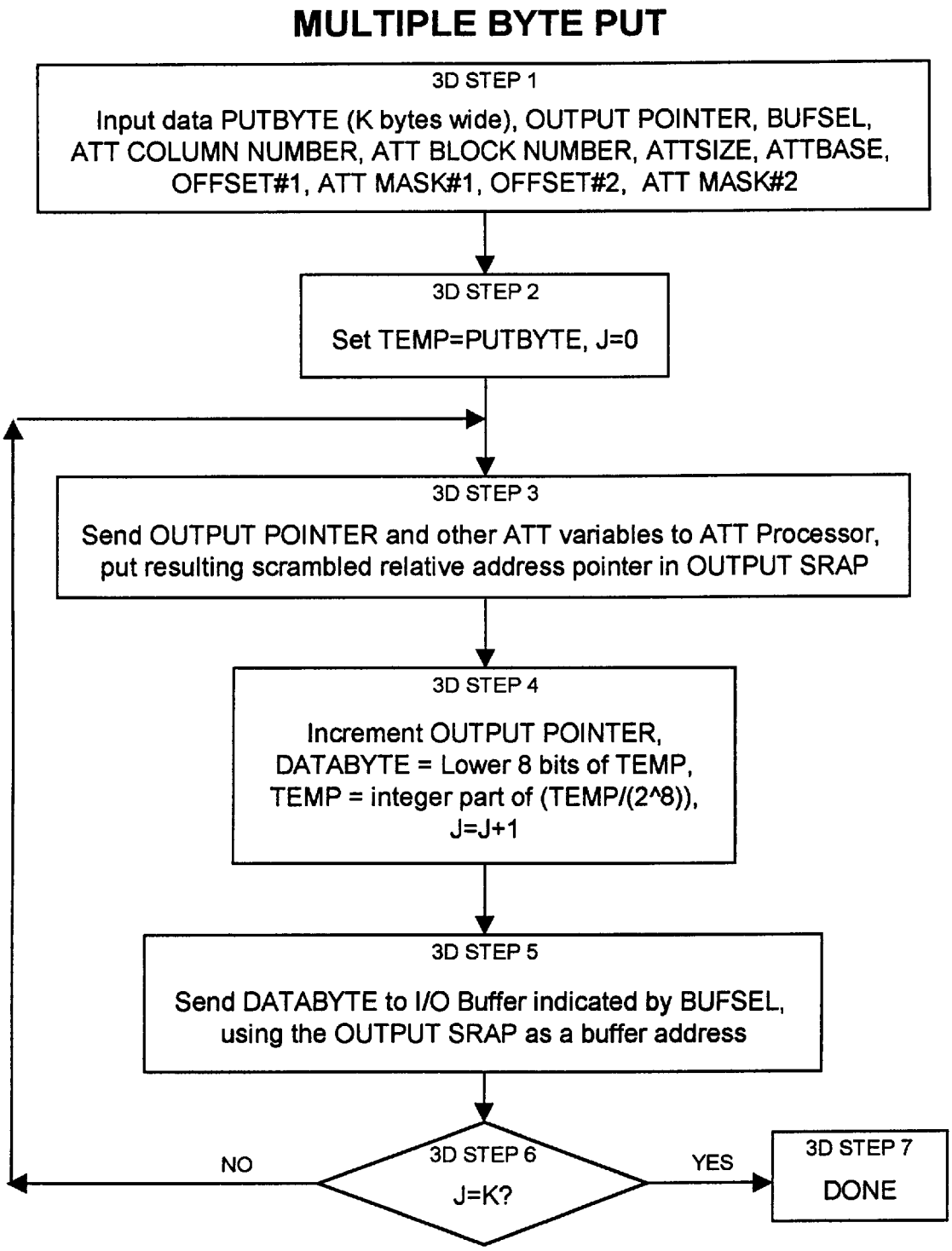
FIG. 3D is a flowchart detailing the multiple byte put (mp) operation.

FIG. 3D, MULTIPLE BYTE PUT, is a description of the MP operation. For this discussion, assume K (not the same K as is used for a pass counter) is equal to 4. 3D STEP 1 shows what variables are needed for the MP operation. A single data item PUTBYTE (K bytes wide), a RAP for the OUTPUT buffer and the related ATT Process information are needed to convert the RAP into a SRAP.

In 3D STEP 2, we set TEMP=PUTBYTE and J=0. J is used as a temporary counter within the MP process.

3D STEP 3, takes the Output RAP and other ATT variables and sends them to the OUTPUT ATT Processor. The resulting SRAP will be the address where a byte of data decatenated from PUTBYTE will be written into the Output Buffer designated by BUFSEL. If BUFSEL=0, the output goes to I/O-B, else if BUFSEL=1 then the output buffer is I/O-A. The SRAP is saved for use in step 5.

3D STEP 4, increments OUTPUT POINTER for use during the next iteration within the MP operation. The lower 8 bits (1 byte) of TEMP is transferred to DATABYTE. Next, the value of TEMP is divided by 28 (or 256, for an 8 bit byte) and the integer result of the division is put back in TEMP. This is the same as shifting the contents of TEMP 8 bits to the right. Then J is incremented by 1. Here J is used as a counter to keep track of how many bytes have been placed in the output buffer.

3D STEP 5, the 8 bit DATABYTE and the OUTPUT SRAP to be used are sent to the output buffer designated by BUFSEL.

3D STEP 6 is used to determine whether there are more bytes to be decatenated and placed into the output buffer. Since J is the local counter, if J is equal to K (because counting started at 0) then the process is done, otherwise the steps 3 through 6 need to be repeated until all of the bytes have been processed.

Figure 3E:
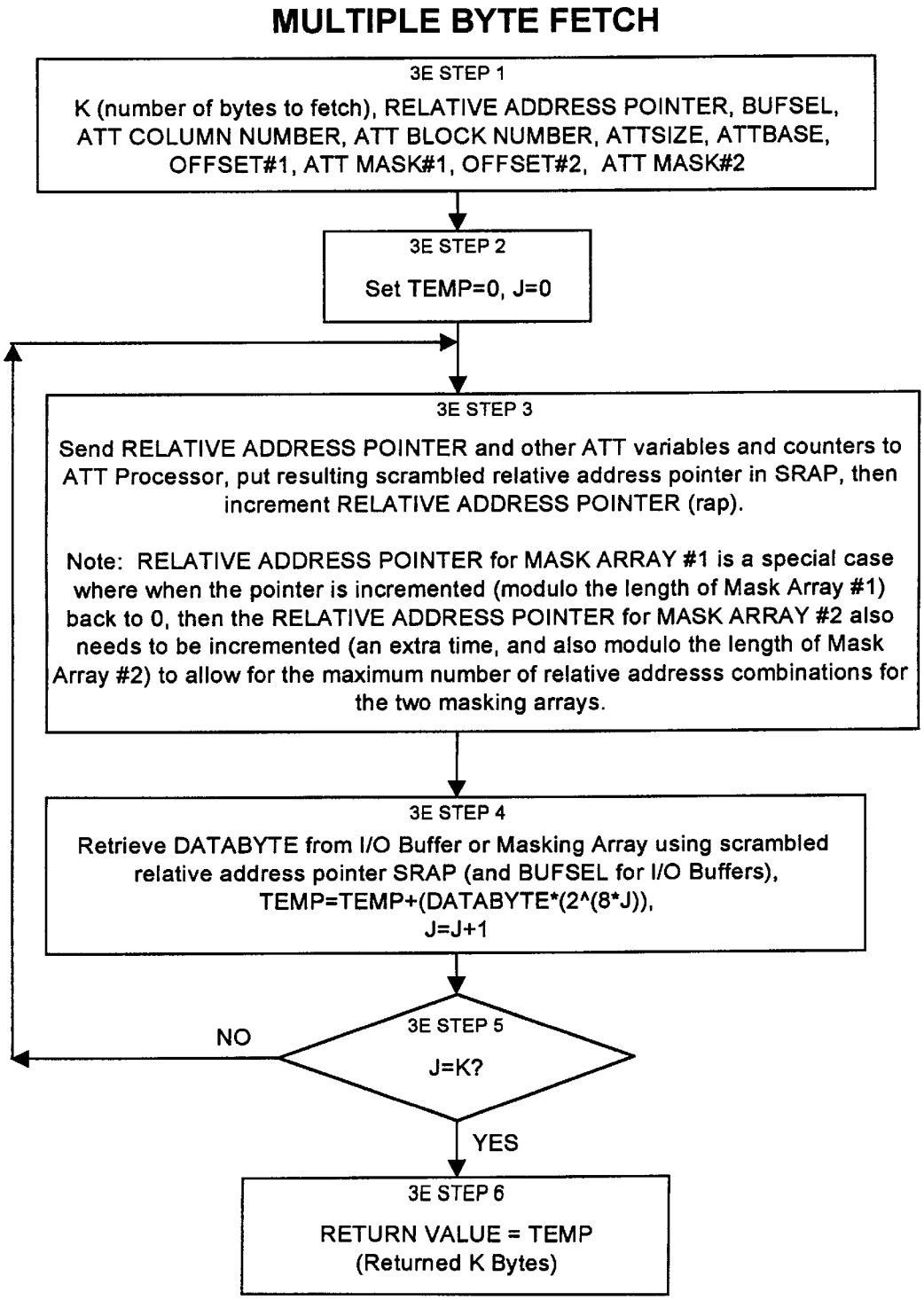
FIG. 3E is a flowchart detailing the multiple byte fetch (mf) operation.

FIG. 3E, MULTIPLE BYTE FETCH, is a description of the MF operation. For this discussion, assume K is equal to 4. 3E STEP 1 shows what variables are needed for the MF operation. A RAP for the source to be accessed and the related ATT Process information needed to convert the RAP into a SRAP.

In 3E STEP 2, TEMP and J are both set equal to 0. J is used as a temporary counter within the MF process.

3E STEP 3, takes the RAP from the respective Pointer and other ATT variables and sends them to the appropriate ATT Processor. The resulting SRAP is the address within the source buffer or array where a byte of data will be retrieved which will be used to create a single concatenated data item.

3E STEP 4, takes the retrieved 8 bit data item, DATABYTE, and multiplies it by $2^{8J}$ which has the effect of left shifting the data byte by 8J bits prior to its being summed into the temporary variable TEMP. J is incremented so that the next time through the DATABYTE will be shifted 8 more bits to the left before being added into TEMP. The address Pointer associated with the RAP being used is incremented for use during the next iteration within the MF operation.

3E STEP 5 checks to see if the appropriate number of bytes have been fetched. If more fetch operations are needed, then 3E STEPs 3 and 4 are repeated until the correct number of bytes have been retrieved. When the correct number of bytes have been retrieved, TEMP contains the single concatenated data item which is the result of the MF operation and is output of the MF operation.

A special note for 3E STEP 3, if the MF operation concerns either of the two masking arrays, then the incrementing of their pointer values follows some special rules. In order to maximize the combinatorial sequences of the entries in the masking arrays, the Pointer for Mask Array #2 will need to incremented an extra time (modulo it's length) whenever the Mask Array #1 Pointer wraps around from the end of the array to its beginning. Since the Mask Array #1 Pointer is also incremented modulo the length of MA#1, if the incrementing of the Array #1 Pointer results in a zero value, then the Array #2 should also be incremented an additional time. Please note, this only involves the Mask Array pointers and not the Input Pointer.

FIG. 4A, is a detailed diagram showing how masking bytes are retrieved from the masking arrays and modified by control variables from ALV before being placed in the mask registers M1 and M2.

The control lines 28*d* and 29*d* are used to synchronize the M1 ATT PROCESSOR, 5A, and M2 ATT PROCESSOR, 5B, so that when the M1 ATT PROCESSOR causes the ARRAY #1 POINTER counter, 96, to wrap around to zero, an extra incrementing control pulse, 28*e* going to OR 100, will be timed with the M2 ATT PROCESSOR's incrementing control pulse, 29*c* also going to OR 100, in such a manner that the two will not interfere with each other. An incrementing control pulse leaving OR 100 via 101 causes the ARRAY #2 POINTER, 97, to be incremented.

The step for retrieving a set of bytes from MASK ARRAY #1 will be described next. The counter, 96, containing ARRAY #1 POINTER's RAP is sent to the M1 ATT PROCESSOR via line 28*a*, the resulting SRAP is sent by 28*b* to the M1 SRAP register, 110. An incrementing control pulse, 28*c*, causes the ARRAY #1 POINTER counter to be incremented after the RAP is sent to the M1 ATT PROCESSOR. The contents of the M1 SRAP register is sent via 36*a* to the address inputs for MASK ARRAY #1. Control lines 36*b* and 35 synchronize the transfer of a mask data byte (addressed by the M1 SRAP) to the MF#1, 8. Once this process has occurred four times, the MF#1 contains a 32 bit wide mask value which is transferred to the ROTATOR, 118, via line 34. Distance and direction information is supplies to ROTATOR 118 by MRV1, 92, via line 108. The Output of the ROTATOR, 118, is sent to XOR, 112, via line 122. The XOR, 112, is constructed in such a manner that each of the 32 input bits is XOR'd with the value of the CF1, 76, status bit from the ALV. The CF1 information is transferred to the XOR via line 102. If CF1=0, then the 32 bit wide result of the XOR operation, line 114, is unchanged and is identical to the 32 bit value from MF#1 on line 34. However, if CF1=1, the 32 out going bits from the XOR on line 114 are the 1's complement of the data on line 34.

The counter, 97, containing ARRAY #2 POINTER's RAP is sent to the M2 ATT PROCESSOR via line 29*a*, the resulting SRAP is sent by 29*b* to the M2 SRAP register, 111. An incrementing control pulse, 29*c*, causes the ARRAY #2 POINTER counter to be incremented via OR 100 and line 101 to ARRAY #2 POINTER, 97, after the RAP is sent to the M2 ATT PROCESSOR. The contents of the M2 SRAP register is sent via 41*a* to the address inputs for MASK ARRAY #2. Control lines 41*b* and 40 synchronize the transfer of a mask data byte (addressed by the M2 SRAP) to the MF#2, 9. Once this process has occurred four times, the MF#2 contains a 32 bit wide mask value which is transferred to ROTATOR, 121, via line 39. Distance and direction information is supplies to ROTATOR 121 by MRV2, 93, via line 109. The Output of the ROTATOR, 121, is sent to XOR, 113, via line 125. The XOR, 113, is constructed in such a manner that each of the 32 input bits is XOR'd with the value of the CF2, 77, status bit from the ALV. The CF2 information is transferred to the XOR via line 103. If CF2=0, then the 32 bit wide result of the XOR operation, line 115, is unchanged and is identical to the 32 bit value from MF#2 on line 39. However, if CF2=1, the 32 out going bits from the XOR on line 115 are the 1's complement of the data on line 39.

The output of the XOR 112, line 114, goes to the select 0 input of MUX 116 and to the select 1 input on MUX 119. The output of the XOR 113, line 115, goes to the select 0 input of MUX 119 and to the select 1 input on MUX 116. ED, 60, and MSF, 78, both status bits in the ALV are sent to XOR 104 via lines 105 and 106, respectively. The result of this XOR is placed on line 107 which goes to the select input on both MUX 116 and MUX 119. Thus, if the select line 107 is equal to 0, the output of MUX 116, line 117, will be the 32 bit wide data on line 114, and the output of MUX 119, line 120, will be the 32 bit wide data on line 115. However, if the select line 107 is equal to 1, then the output of MUX 116, line 117, will be the 32 bit wide data on line 115 and the output of MUX 119, line 120, will be the 32 bit wide data on line 114.

Figure 4B:
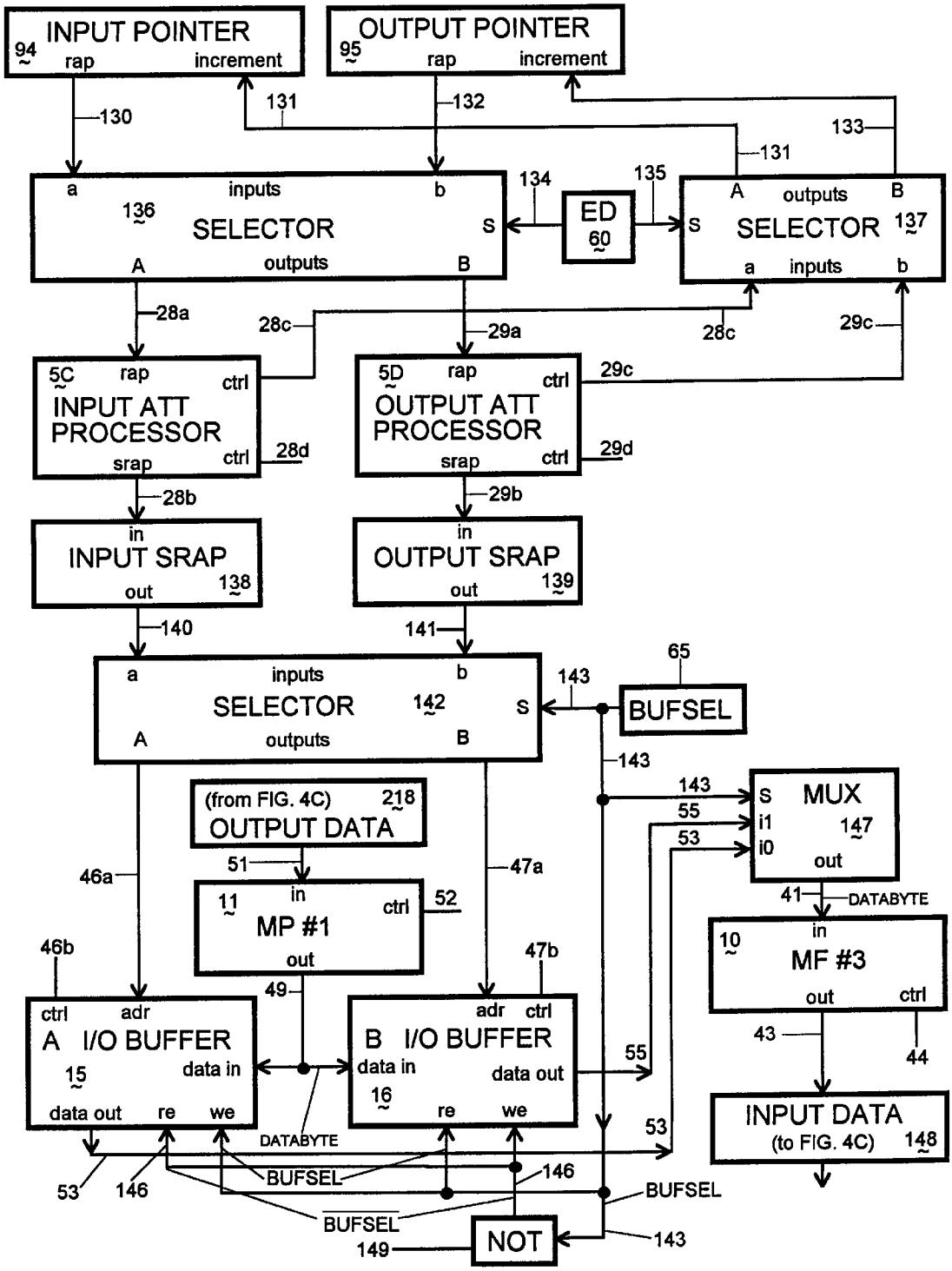
FIG. 4B is a diagram showing the mf and mp operation as they apply to data i/o operations.
Figure 4C:
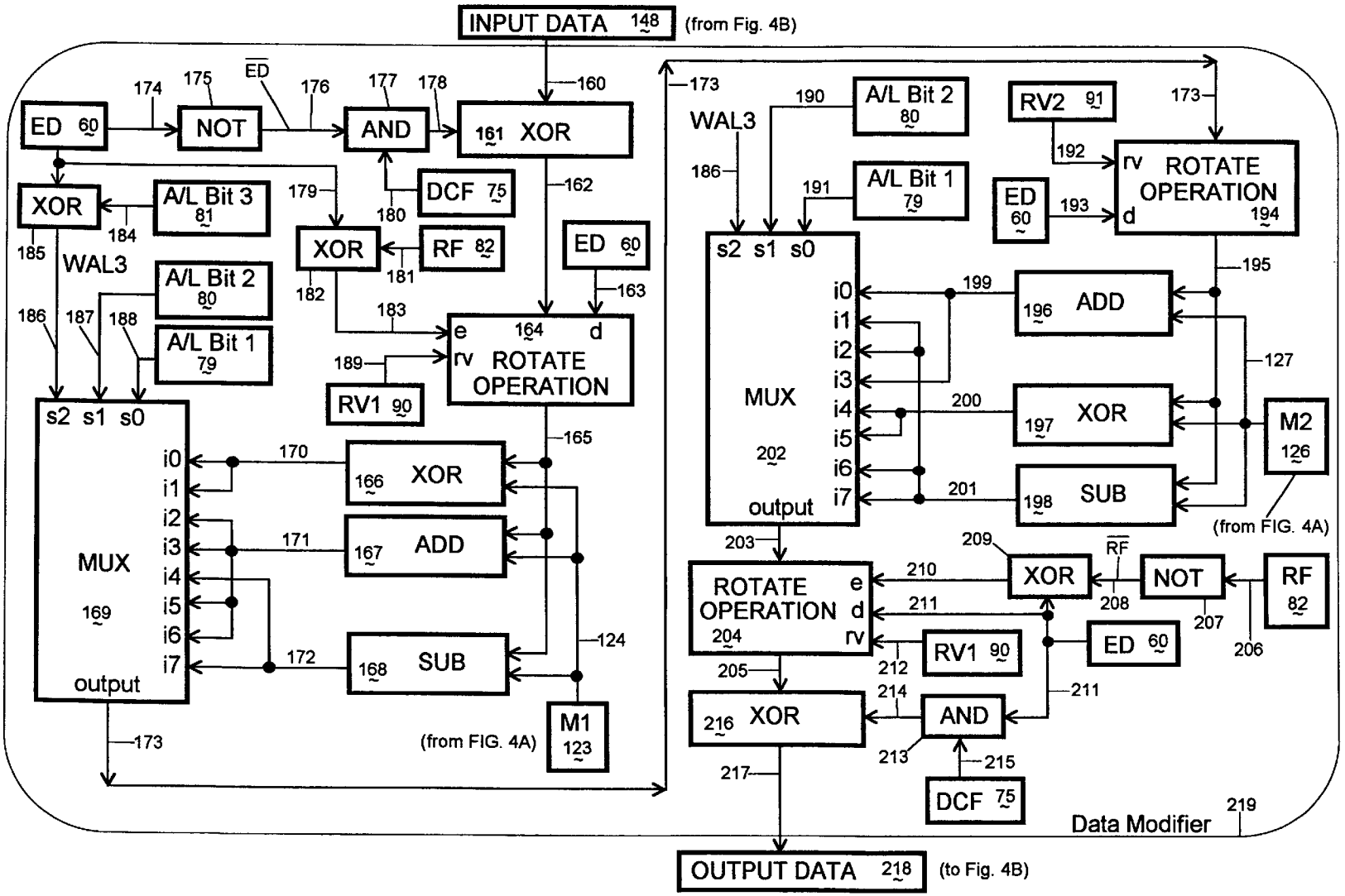
FIG. 4C is a diagram detailing the operation of the data modification operation.

The 32 bit wide output of MUX 116, line 117, goes to the M1 register 123 where it is held for use by the data modifier (see FIG. 4C). The 32 bit wide output of MUX 119, line 120, goes to the M2 register 126 where it is held for use by the data modifier (see FIG. 4C).

FIG. 4B, is a detailed diagram showing the input and output MF and MP operations. ED, 60, is equal to 0 for encryption and is equal to 1 for decryption. ED, 60, is a bit within ECV1. ED is sent to two SELECTORS, 136 and 137, by lines 134 and 135 respectively. The counter,94 containing the INPUT POINTER goes to SELECTOR 136 via line 130, and the counter, 95 containing the OUTPUT POINTER goes to the same SELECTOR, 136, via line 132. When ED=0, the INPUT POINTER RAP goes from the SELECTOR to the INPUT ATT PROCESSOR, 5C, via 28*a* while the OUTPUT POINTER RAP goes from the SELECTOR to the OUTPUT ATT PROCESSOR, 5D, via line 29*a*. If ED=1, the destinations are swapped. That is the SELECTOR sends the INPUT POINTER RAP via 29*a* to the OUTPUT ATT PROCESSOR, 5D, and at the same time the SELECTOR sends the OUTPUT POINTER RAP via 28*a* to the INPUT ATT PROCESSOR, 5C. This enables decryption to undo the address scrambling which occurred during encryption.

In a similar fashion, SELECTOR 137 routes the incrementing control pulses 28*c* and 29*c* to the appropriate address counters. When ED=0, the INPUT ATT PROCESSOR incrementing control pulse, 28*c*, goes through the SELECTOR, 137, via line 131 to the counter containing the INPUT POINTER, 94. And the OUTPUT ATT PROCESSOR incrementing control pulse, 29*c*, goes through SELECTOR, 137, via line 133 to the counter containing the OUTPUT POINTER, 95. When ED=1, the SELECTOR, 137, routes the INPUT ATT PROCESSOR incrementing control pulse, 28*c*, via line 133 to the counter for the OUTPUT POINTER, 95. And the SELECTOR, 137, routes the OUTPUT ATT PROCESSOR incrementing control pulse, 29*c*, via line 131 to the counter for the INPUT POINTER, 94. Control lines 28*d* and 29*d* are used to synchronize the ATT PROCESSORS, 5C and 5D, with the timing of the rest of the MF#3 and MP#1 operations.

The SRAP from the INPUT ATT PROCESSOR, 5C, is sent via 28*b* to the INPUT SRAP register, 138. The SRAP from the OUTPUT ATT PROCESSOR, 5D, is sent via 29*b* to the OUTPUT SRAP register, 139. The INPUT SRAP, 138, goes to SELECTOR 142 via line 140, while the OUTPUT SRAP, 139, goes to the same SELECTOR, 142, via line 141. The action of the SELECTOR, 142, is controlled by BUFSEL, 65, via line 143. When BUFSEL=0, the SELECTOR, 142, sends the INPUT SRAP, 138, to the address inputs of A I/O BUFFER, 15, via line 46*a* and also sends the OUTPUT SRAP, 139, to the address inputs of B I/O BUFFER, 16, via 47*a*. When BUFSEL=1, the SELECTOR, 142, reverses the outputs and sends the INPUT SRAP, 138, to the address inputs of B I/O BUFFER, 16, via 47*a*, and then sends the OUTPUT SRAP, 139, to the address inputs of A I/O BUFFER, 15, via 46*a*.

BUFSEL, 65, and its complement BUFSEL- (the output of the inverter 149, line 146) are used to selectively enable or disable the output of the I/O Buffers, 15 and 16. BUFSEL=0 and BUFSEL-=1, via 146 and 143, read enables the A I/O Buffer and write enables the B I/O Buffer. BUFSEL=1 and BUFSEL-=0, via 146 and 143, read enables the B I/O Buffer and write enables the A I/O Buffer. BUFSEL, 65, also goes via line 143, to the select input of MUX 147. The output of the A I/O Buffer, 15, goes via line 53 to the 0 select input on MUX 147 while the output of the B I/O BUFFER, 16, goes via 55 to the 1 select input on MUX 147. When BUFSEL=0, MUX 147 selects the 8 bit data from the A I/O Buffer (via 53) and sends the data byte from MUX 147 via line 41 to the MF#3 processor, 10. When BUFSEL=1, MUX 147, selects the 8 bit data from the B I/O Buffer (via 55) and sends the data byte MUX 147, via line 41 to the MF#3 processor, 10.

After the read process has been performed 4 times, the output of MF#3 is a 32 bit wide concatenated data byte which is sent via 43 to the register INPUT DATA, 148.

Control lines 52 (going to MP#1, 11), 44 (going to MF#3, 10), 46*a* (going to A I/O BUFFER, 15) and 47*b* (going to B I/O BUFFER, 16) are used to synchronize the I/O process to prevent any address, data, or timing conflicts.

The 32 bit wide modified data byte, OUTPUT DATA, 218, goes via 51 to the MP#1 processor, 11. The output of the MP#1 process, 11, is a 8 bit wide byte which is sent via 49 to the data inputs of both I/O Buffers. Only the buffer whose data input is enabled via BUFSEL will actually take the 8 bit data byte on line 49 and write it into the buffer. As previously described, the write enabled buffer uses OUTPUT SRAP sent to it via SELECTOR 142 as the address where the data byte is to be written.

FIG. 4C, is a diagram showing the details of the Data Modification Operation, DM, FIG. 1 item 7. ED, 60, the 1 bit status bit from the ECV1 byte, is sent via 174 to the inverter 175. The output of the inverter, 175, is ED– which is sent via 176 to AND 177. When ED=0, the value on line 176 will be a 1 (logical true) which causes the output of AND 177 to reflect the value of the DCF, 75, input via line 180. If DCF=0 then the output of AND 177 on line 178 is 0 while if DCF=1, then the output of AND 177 on line 178 is also 1. When ED=1, then ED– is 0 and this 0 value going via 176 causes the output (line 178) of AND 177 to always be equal to 0, and the 0 going to the XOR 161 is effectively a no change operation within the XOR. Consequently, only when ED=0 (for encryption), is the value of DCF passed on to the XOR 161. When ED=1, the value of DCF is ignored and the output, 162 of XOR 161, equals the input to the XOR, line 160.

XOR 161 is constructed so that the input on line 178 is XOR'd with each of the 32 input bits supplied on line 160, and thus, the 32 bits supplied as an output on line 162 are either the same as the 32 bits of input on line 160, or they are the 1's complement of the 32 bits on line 160. That is only when DCF (Data Complement Flag)=1 and ED=0 is the output of XOR 161 the 1's complement of the XOR's input.

The output of XOR 161 is a 32 bits wide data byte which is the input to a 32 bit wide ROTATE OPERATION, 164. ED (Encrypt/Decrypt Flag), 60, also goes via line 163 to the first ROTATE OPERATION, 164, where it is used to complement the value of the sign (direction) bits of the RV1, 90, variable sent to the Rotator via line 189. The 32 bit wide output of the ROTATE OPERATION, 164, goes out on line 165.

RF (Rotate First) flag, 82, (from the ALV variable, see FIG. 2C) is an input, via line 181 to XOR, 182. The other input to XOR 182 is ED, 60, via line 179. The output of XOR 182 goes via line 183 to the enable input of the first ROTATE OPERATION, 164. Therefore, this first rotate operation is enabled only when [ED=0 and RF=1] or [ED=1 and RF=0]. Or, in other words, only when the RF flag is set during Encryption, or the RF FLAG is cleared during Decryption will this first rotate operation be enabled.

In the lower right quadrant of FIG. 4C is shown how the third ROTATE OPERATION, 204 is enabled. RF, 82, goes via 206 to inverter 207, whose output RF– is 208 which is an input to XOR 209. The other input to XOR 209, is ED, 60, via line 211. The output of the XOR 209, goes via line 210 to the enable input of the third ROTATE OPERATION, 204. The rotate direction and distance for the third Rotate Operation is supplied by variable RV1, 90, which goes via line 212 to the ROTATE OPERATION, 204. Again ED, 60 via line 211, goes to the third ROTATE OPERATION, 204, where it is used to change the direction of the rotate (as supplied by RV1) only if ED=1. Otherwise, when ED=0, the rotate direction is unchanged. The third rotate operation is enabled only when [ED=0 and RF=0] or [ED=1 and RF=1].

DCF (Data Complement Flag), 75, goes via line 215 to AND 213. The other input of AND 213 is ED, 60, via line 211. The output of AND 213 goes via line 214 to the XOR 216 where it is used to XOR each of the 32 input bits of the XOR's input (via 205). The effect of this is that only when ED=1 does DCF have any possibility of modifying the input to XOR 216. When ED=0, the output of AND 213 will always be 0 and therefore the output (line 217) of XOR 216 will always be the same as the input (line 205) going to XOR 216.

The table below shows the effect of ED and RF on the three Rotate Operations within the DATA Modifier, 219.

| ED | RF | First ROTATE OPERATION (164) e = ED ⊕ RF | Second ROTATE OPERATION (194) | Third ROTATE OPERATION (204) e = ED ⊕ RF– |
|---|---|---|---|---|
| 0 | 0 | DISABLED | enabled | ENABLED |
| 0 | 1 | ENABLED | enabled | DISABLED |
| 1 | 0 | ENABLED | enabled | DISABLED |
| 1 | 1 | DISABLED | enabled | ENABLED |

Note that in this preferred embodiment the second Rotate Operation is always enabled and that the first and third Rotate Operations are not enabled or disabled at the same time. Another preferred embodiment eliminates the RF flag (in ALV) and uses a RV3 (variable and counter) for the third Rotate Operation, 204.

The Table below shows the effects of ED and DCF on the data flow out of each of the 32 bit wide XORs used in the Data Modifier, 219.

| ED | DCF | Output of XOR 161 | Output of XOR 216 |
|---|---|---|---|
| 0 | 0 | same as input | same as input |
| 0 | 1 | 1's complement | same as input |
| 1 | 0 | same as input | same as input |
| 1 | 1 | same as input | 1's complement |

Going back to the first ROTATE OPERATION, 164, the 32 bit wide output of this Rotate Operation goes out via line 165 to XOR 166, ADD 167, and SUB 168. Additionally, M1, 123, (see FIG. 4A) the 32 bit wide masking value derived from Mask Array #1, goes via line 124 to XOR 166, ADD 167, and SUB 168. The 32 bit wide output of XOR 166, goes via line 170 to select 0 and 1 inputs of MUX 169. The 32 bit wide output of ADD 167 goes via line 171 to the select 2, 3, 5 and 6 inputs of MUX 169. And, the 32 bit wide output of SUB 168 goes via line 172 to the select 4 and 7 inputs of MUX 169.

For both MUX 169 and MUX 202, the select 0 inputs, s0, are controlled by the ALV bit, A/L Bit 1 (79), via lines 188 and 191 respectively. The select 1 inputs, s1, are controlled by the ALV bit, A/L bit 2 (80), via lines 187 and 190. The ALV bit, A/L bit 3 (81) goes to XOR 185 via line 184 while ED, 60 also goes to the XOR 185 via line 179. The output of XOR 185, WAL3, goes via line 186 to the select 2 inputs, s2, of both MUX 169 and MUX 202. The inputs of the MUX's have been arranged so that when ED complements the A/L Bit 3, it causes a reverse arithmetic/logic operations to be performed (along with ED complementing the rotate and the MSF control bit) on the input data, see the discussion on FIG. 2C.

The 32 bit wide output of MUX 169, goes via line 173 to the input of the second ROTATE OPERATION, 194, (32 bits wide). This Rotate Operation is always enabled. The rotate value variable RV2, 91, via line 192 specifies the direction and distance of this rotate operation, while ED, 60, via line 193 reverses the rotate direction when ED=1. The 32 bit wide output of the second ROTATE OPERATION, 194, goes via line 195 to ADD 196, XOR 197 and SUB 198. Additionally, M2, 126, (see FIG. 4A) the 32 bit wide masking value derived from Mask Array #2, goes via line 127 to ADD 196, XOR 197 and SUB 198. The 32 bit wide output of ADD 196 goes via line 199 to the select 0 and 3 inputs of MUX 202. The 32 bit wide output of XOR 197 goes via line 200 to the select 4 and 5 inputs of MUX 202. And the 32 bit wide output of SUB 198 goes via line 201 to the select 1, 2, 6 and 7 inputs of MUX 202.

The 32 bit wide output of MUX 202, goes via 203 to the third ROTATE OPERATION, 204 (see prior discussion of this rotate operation). The 32 bit wide output of the third ROTATE OPERATION, 204, goes via line 205 to XOR 216 (also previously discussed), then via line 217 to the 32 bit wide OUTPUT DATA register, 218 (see also FIG. 4B).

Figure 5A:
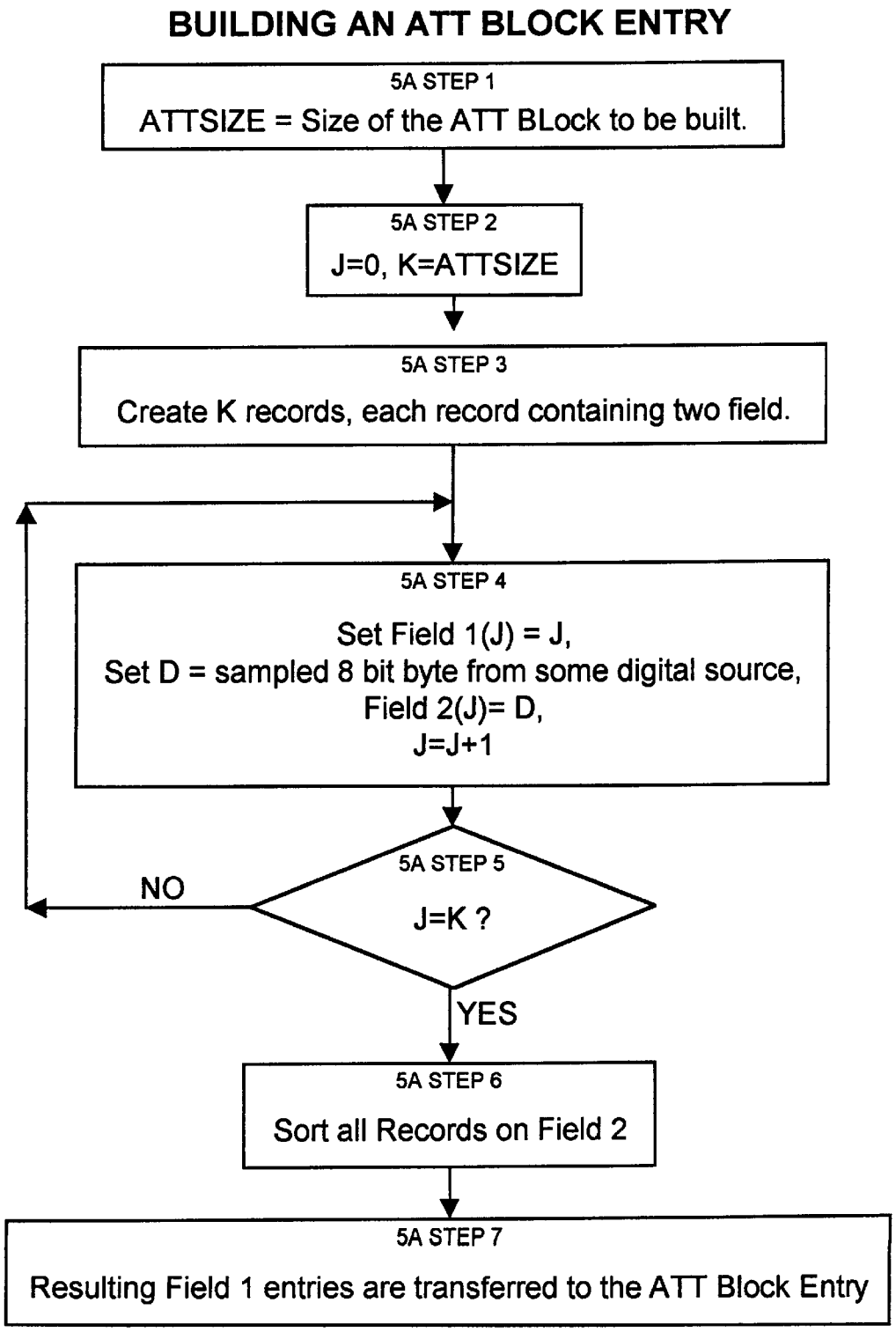
FIG. 5A is a flowchart showing how att block entries are made.

FIG. 5A is a flowchart showing how an ATT Block Entry is made. In 5A STEP 1, ATTSIZE is the size of the ATT Block to be made. 5A STEP 2 sets the local counter J equal to 0 and sets K equal to the size of the block to be built. Note that RAP entries must be in the range of 0 up to ATTSIZE−1.

5A STEP 3, creates K records where each record contains two fields. The first field will holds an integer which will become the RAP entry, and the second field will contain an 8 bit byte sampled from some digital source. This 8 bit byte may also be a byte stream from a pseudo-random number generator, or even a text file.

5A STEPs 4 & 5 fill all of the first fields with sequential values of J (0 to ATTSIZE−1) while the second fields are filled with sampled (arbitrary) 8 bit bytes. When this process is complete, 5A STEP 5 no longer goes back to 5A STEP 4, but instead goes to 5A STEP 6.

5A STEP 6 sorts all of the K records in ascending order by the contents of the second field. As the sorting takes place, the field 1 entries are shuffled around.

5A STEP 7, the shuffled field 1 entries are transferred to the ATT Block Entry.

FIG. 5B shows the structure of an ATT Column which makes up the ADDRESS TRANSLATION TABLES. The number of ATT Columns is only limited by the amount of storage available. Each ATT Column has a unique number assigned to it, so that an ATT Processor knows which ATT Column to use. The next entry in the Column is ATTN which specifies how many ATT Block Entries are in that Column. Following the ATTN is ATTSIZE which specifies the size of the ATT Block entries within the Column. Next is ATTBASE which is the number base to be used for the ATT calculations with the ATT Block Entries for this ATT Column. Each Block entry contains a jumbled sequence of RAPs. The example illustrated by FIG. 5B shows two ATT Columns, the first containing three 1024 entry Blocks, while the second contains 5 16384 entry Block.

Figure 6:
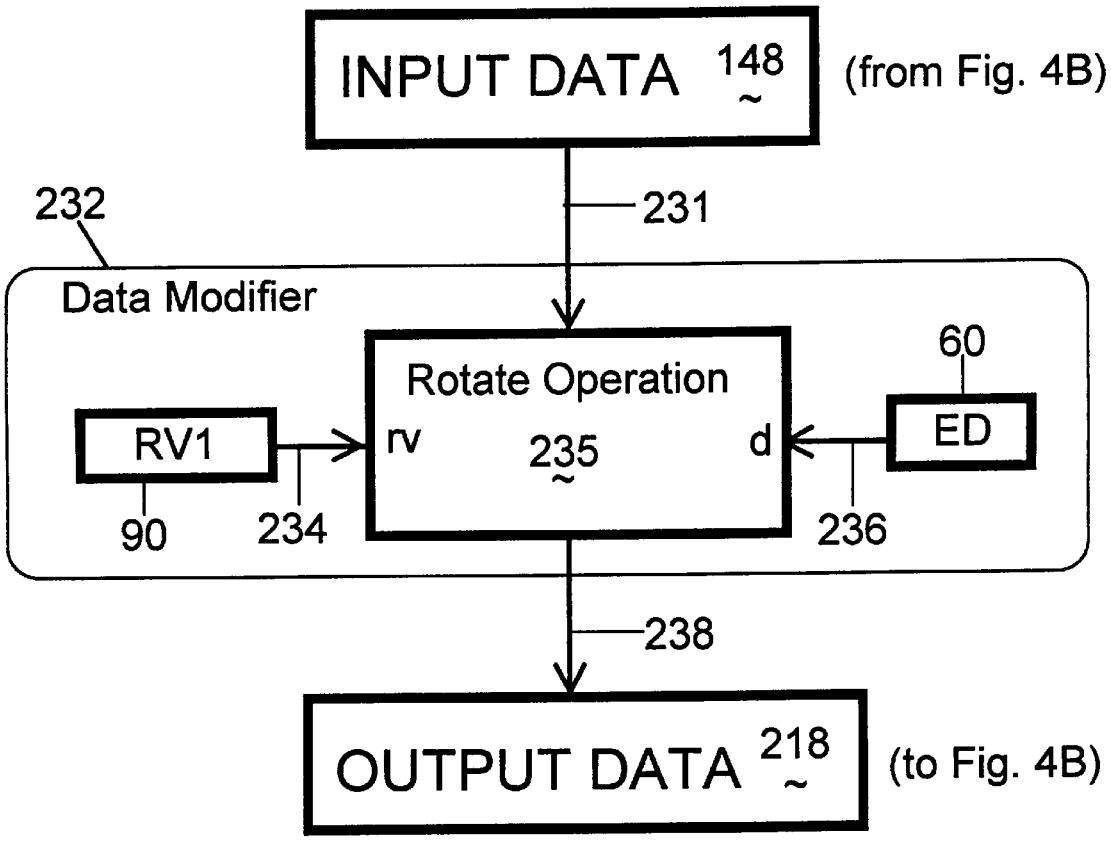
FIG. 6 is a diagram showing the operation of a simple data modification operation with only a rotate element.

FIG. 6 shows a simplified Data Modifier, 232, which could replace the previously described Data Modifier, 219. The Data Modification consists only of just a Rotation Operation, 235. Again ED, 60, via 236 to the Rotator, 235, causes the direction of rotation, indicated by RV1, 90, via 234 to 235, to be switched when ED=1. Thus, the Rotation Operation for Decryption will be in the opposite direction than was used for Encryption.

Figure 7:
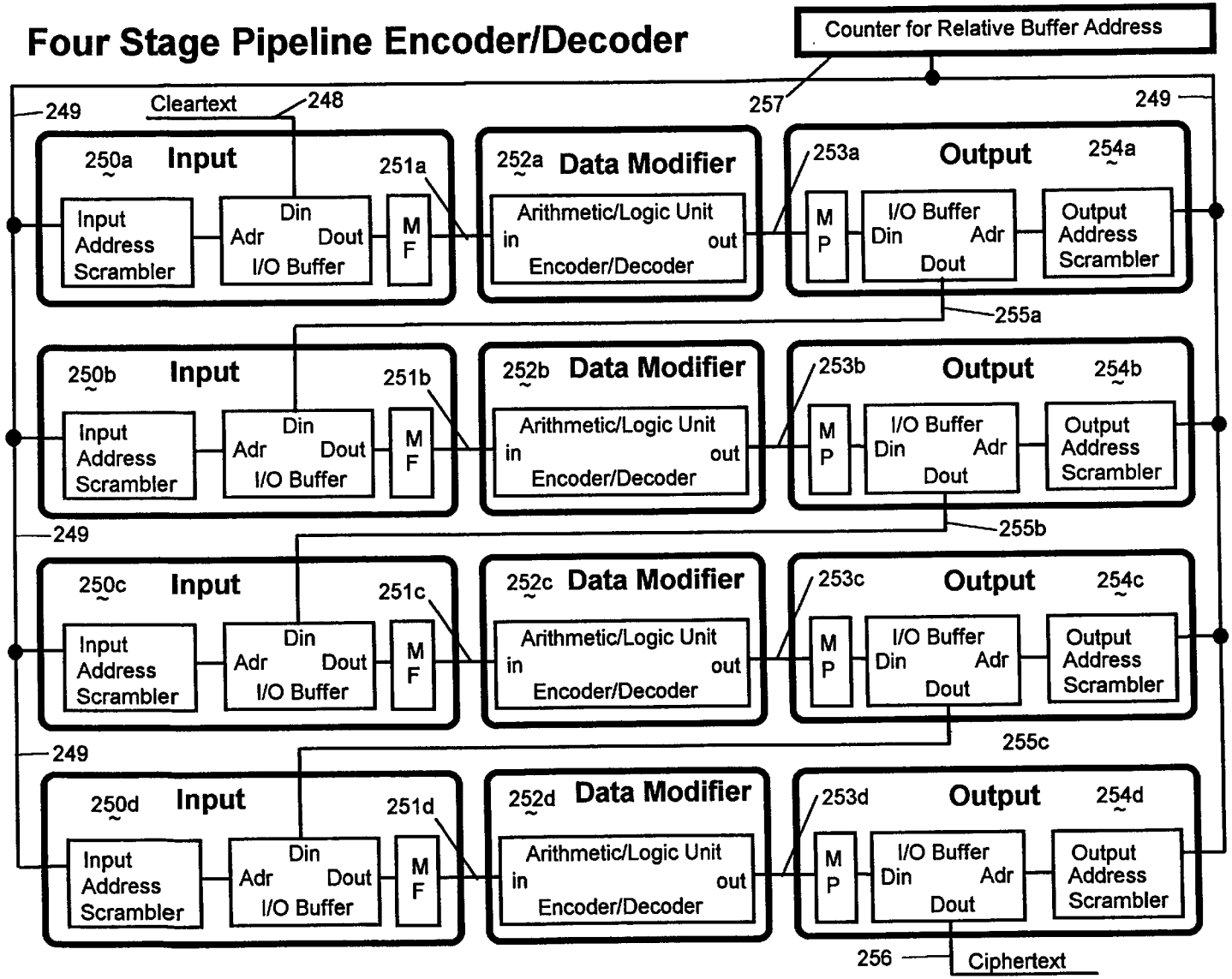
FIG. 7 is a diagram illustrating how multiple encoders may be pipelined together.

FIG. 7 shows a four stage pipeline Encoder/Decoder. It consists of four individual Encoders, (250*a*–254*a*, 250*b*–254*b*, 250*c*–254*c*, and 250*d*–254*d*). A common RAP counter, 257, via 249 is used to supply RAPs for the use of all four Encoders. Initially a Cleartext, 248, is loaded into the input buffer of 250*a*. When done, the first Encoder contains intermediate-text in the output buffer within 254*a*. Then when another buffer of Cleartext is loaded via 248 into the input buffer within 250*a*, the output buffer of 253*a* is transferred to the input buffer of the second Encoder via 255 to the input buffer of 250*b*. This process is repeated with successive encoders. When the fourth Encoder's output buffer within 254*d* is filled, the Ciphertext is transferred via 256 to the user for distribution in some manner. At this point, the only delay in processing four passes of encryption/decryption is only the time needed to process 1 buffer. Thus, the pipeline structure, with multiple Encoders, is a very fast and effective method to encrypt and decrypt information.

FIG. 8 is a tabular representation of the average number of segments (bytes) containing the original 8 bits as a function of the number of passes between 1 and 32. Also shown is that average sorted original bit density per segment (byte). The entries were derived from a software simulator. An illustration of an unsorted density is that the two segments resulting from pass 1 would on average both have an equal probability of containing 4 bits each. This is because sometimes the larger portion may be on one side of the original byte boundary and sometimes it would be on the other. Therefore, for sorted statistics, the bit densities are arranged in declining order before being averaged into previous distributions. Consequently after 5 passes, the approximate average bit density (in some location of bytes in a buffer) would be 3,2,1,1,1 (with rounding). That is the original eight bits of a byte would now be dispersed within 5 other bytes in the output buffer with one byte containing 3 bits, another byte containing 2 bits, and three other bytes each containing 1 bit of the original byte. Thus, the data becomes its own dispersing medium.

The size for the biggest segment ($X1_P$) of the sorted bit density of 8 original bits as a function of P, the number of passes is approximated by the formula (Eq. 6) shown below:

$$X1_p = \left[ e^{\left[ \left( \frac{\ln(7)^{P+.08838}}{\ln(9)^{P-.955806}} \right) \left[ .822907^{(P^{.344194})} \right] \right]} \right] - .1 \qquad \text{Eq. 6}$$

Figure 9:
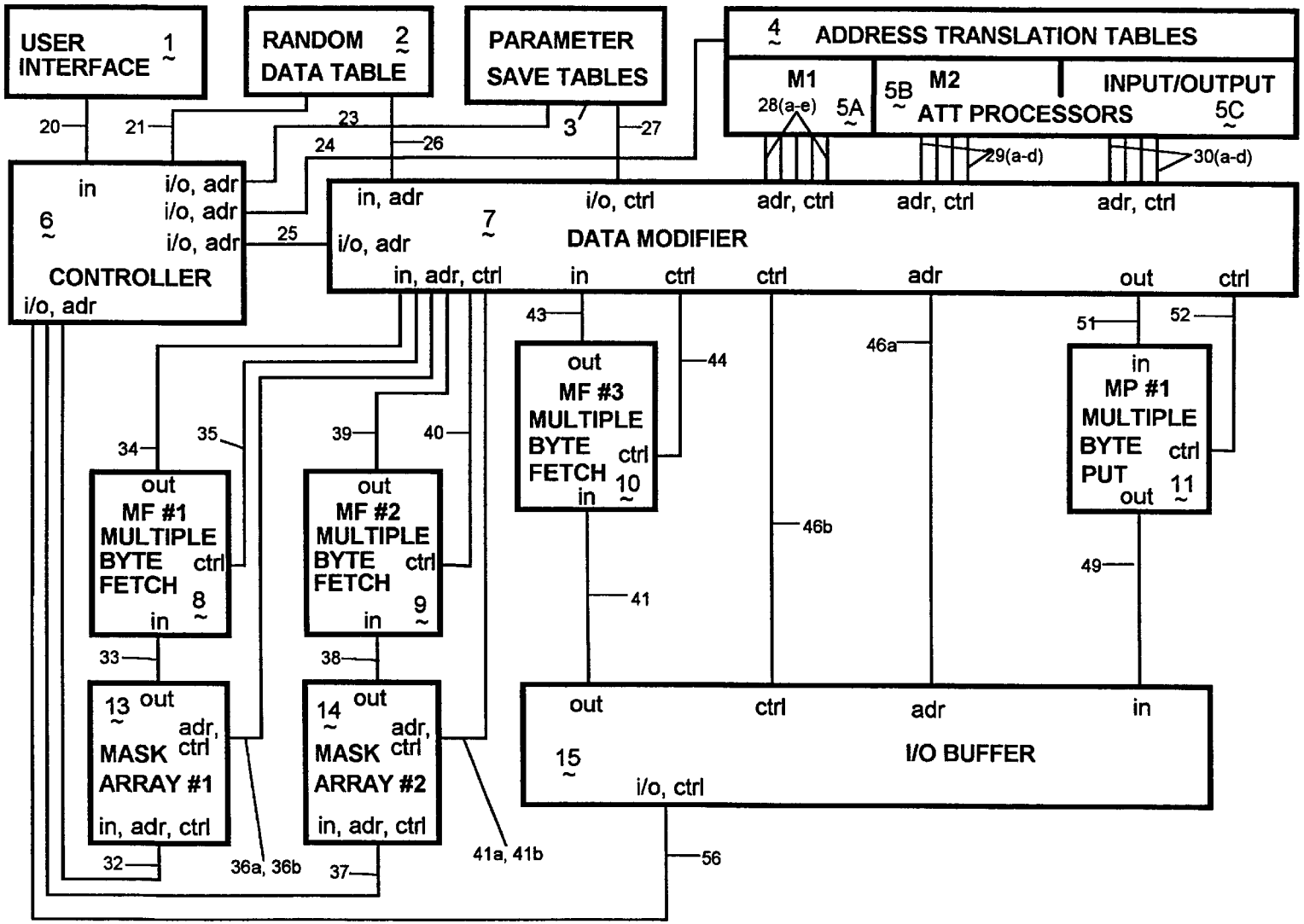
FIG. 9 is a block diagram of the encryption engine using only one I/O Buffer.

FIG. 9 is basic block diagram of another preferred embodiment of the Encoder/Decoder Engine. In this embodiment only one I/O buffer is used (eliminating the need for the BUFSEL buffer indicator). This scheme is useful where storage space is limited. The ATT processors for input and output (FIGS. 1 5C and 5D) have been combined and are now labled 5C on FIG. 9. Operation is similar to that described for the Encoder/Decoder Engine in FIG. 1. except that the same buffer addresses (SRAP's) are used for both the MF#3 and MP#1 operations.

Figure 10:
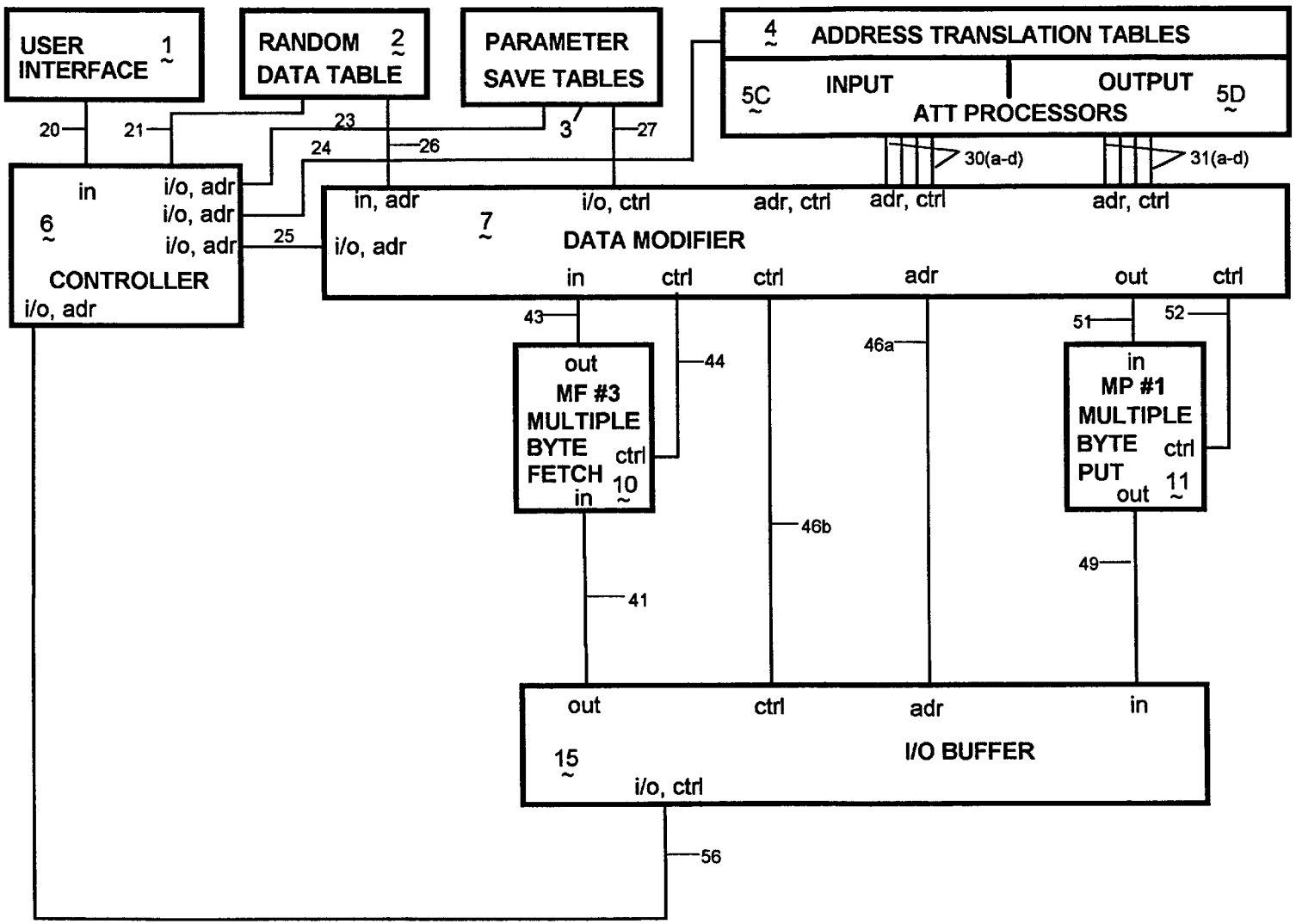
FIG. 10 is a block diagram of a simple encryption engine without the use of masking arrays and multiple I/O buffers.

FIG. 10 is basic block diagram of another preferred embodiment of a simple Encoder/Decoder Engine. This embodiment, similar to FIG. 9, uses only one I/O Buffer, the masking arrays are not implemented. The data modifier used with this preferred embodiment is shown in FIG. 6. This method provides encryption/decryption by the scrambling of bits within the buffer through the application of one or more passes consisting of concatenation (from the I/O buffer), rotation (directed by the RDT) and decatenation (back into the same locations within the I/O Buffer as used during the concatenation operation). The degree of security is influenced by the randomness of the rotation distances employed, the variety of the RAP values used (SRAPs), and the number of processing passes performed on the I/O Buffer (see FIG. 8).

In summary, multiple applications of the combination of the concatenation of multiple bytes from an input buffer (with permutation of sequence), into a single item, the rotation of this item by an arbitrary amount, the decatenation of the item back into individual bytes, and the placement of these bytes into an output buffer (with permutation of sequence), results in an effective encryption/decryption method.

The schemes and strategies to be employed are only limited by the imagination of the sender and the receiver and with thought and planning, true one-time pad encoded messages may be easily created with this invention given the vast amount of digital information to choose from as sources for our sampling scheme. The security of this invention lies not in the security of the logic/mathematic operations utilized, but rather it lies in the obscurity of the keys, Random Data tables and passwords employed. Other variations of the foregoing Examples and uses are possible.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. Encryption/Decryption apparatus comprising:

a. means for retrieving information to be encoded/decoded, said information defining an array D1 of first elements, b. means for combining of the first elements of D1 by concatentation of at least one to another of said first elements of D1, wherein said concatenation results in formation of second elements of an array D2, and wherein the number of second elements is less than the number of first elements, but where at least one of the second elements is larger than at least one of the first elements, c. means for barrel rotating and modifying at least one of the second elements of D2, and d. means for converting and decatenating said modified second elements of array D2 back into the first elements of D1, and e. an array of R elements, said R elements arranged to provide information for directing and controlling one or more of elements b, c, and d.

2. The apparatus as defined in claim 1 further comprising means for permuting the order of said first and second elements being concatenated, rotated, modified, converted and decatenated,.

3. The apparatus as defined in claim 1 further comprising an array S wherein said array S is arranged to provide information, in addition to array R, for directing and controlling one or more of elements b, c, and d.

4. The apparatus as defined in claim 1 further comprising:

e. third elements, f. means for combining at least one second element of D2 with said third elements to form an array D3, and g. means for converting said array D3 back into said array D2.

5. The apparatus as defined in claim 4 wherein said means for combining comprises:

means for arithmetic and logic combining selected from the group consisting of means for adding, subtracting, exclusive-oring and rotating.

6. The apparatus as defined in claim 5 wherein said means for arithmetic and logic combining comprises means for converting into another number base.

7. The apparatus as defined in claim 4 wherein said third elements are selected form the group consisting of passwords, constants, address registers, counters, mask arrays, random number sources, pseudo-random sources, arbitrary number sources, and the contents of memory locations.

8. The apparatus as defined in claim 4 further comprising:

means for repeating item f.

9. The apparatus as defined in claim 1 further comprising:

means for indexing into said arrays.

10. The apparatus as defined in claim 9 where said means for indexing comprises at least a number formed in any number base.

11. The apparatus as defined in claim 1 wherein said means for combining includes means for permuting, and said means for converting and decatenating includes means for permuting back, and further comprising:

e. third elements, wherein third elements are selected from the group consisting of passwords, constants, address registers, counters, mask arrays, random number sources, pseudo-random number sources, arbitrary number sources, and the contents of memory locations, and means for combining said third elements with said second elements of array D2 for form an array D3, f. means for indexing into any array, D1, D2, and D3, g. means for arithmetic and logic combining selected from the group consisting of means for adding, subtracting, exclusive-oring or rotating, h. means for converting the result of item f. into another number base, and i. means for converting said array D3 back into said array D2.

12. A method for encryption/decryption comprising the steps of:

a. retrieving information to be encoded/decoded, said information defining an array D1 of first elements, b. combining of the first elements of D1 by concatenation of said first elements of D1, one to another, wherein said concatenation results in formation of second elements of an array D2, wherein the number of second elements is less than the number of first elements, but where at least one of the second elements is larger than at least one of the first elements, c. barrel rotating and modifying at least one of the second elements of array D2, and d. converting and decatenating said modified second elements of array D2 back into the first elements of D1, and e. providing an array of R elements, said R elements arranged to provide information for directing and controlling one or more of elements b, c, and d.

13. The method as defined in claim 12 further comprising the steps of:

e. retrieving an array of third elements, f. combining at lease one second element of D2 with said third elements to form an array D3, and g. converting said array D3 back into said array D2.

14. The method as defined in claim 13 wherein said combining comprises the step:

arithmetic and logic combining selected from the group consisting of adding, subtracting, exclusive-oring or rotating.

15. The method as defined in claim 14 wherein said arithmetic and logic comprises converting into another number base.

16. The method as defined in claim 13 wherein said third elements are selected from the group consisting of passwords, constants, address registers, counters, mask arrays, random number sources, pseudo-random number sources, arbitrary number sources, and the contents of memory locations.

17. The method as defined in claim 13 further comprising the step of:

repeating step f.

18. The method as defined in claim 13 further comprising the step of indexing into said arrays.

* * * * *